US005974375A

United States Patent [19]

Aoyagi et al.

[11] Patent Number: 5,974,375

[45] Date of Patent: Oct. 26, 1999

[54] CODING DEVICE AND DECODING DEVICE OF SPEECH SIGNAL, CODING METHOD AND DECODING METHOD

[75] Inventors: Hiromi Aoyagi; Xuedong Yang; Atsushi Yokoyama, all of Minato-ku, Japan

[73] Assignee: Oki Electric Industry Co., Ltd., Tokyo, Japan

[21] Appl. No.: 08/978,353

[22] Filed: Nov. 25, 1997

[30] Foreign Application Priority Data

Dec. 2, 1996 [JP] Japan ..... 8-321314
Nov. 19, 1997 [JP] Japan ..... 9-318598

[51] Int. Cl.[6] ..... G10L 5/02

[52] U.S. Cl. ..... 704/216; 704/223; 704/229

[58] Field of Search ..... 704/201, 205, 704/208, 210, 214, 215, 216, 219, 223, 225, 226, 229

[56] References Cited

U.S. PATENT DOCUMENTS 5,276,765 1/1994 Freeman et al. ..... 704/233
5,475,712 12/1995 Sasaki ..... 704/219
5,509,102 4/1996 Sasaki ..... 704/219
5,689,615 11/1997 Benyassine et al. ..... 704/219
5,778,334 7/1998 Ozawa et al. ..... 704/214
5,812,965 9/1998 Massaloux ..... 704/205

OTHER PUBLICATIONS

Andrew DeJaco, William Gardner, Paul Jacobs, and Chong Lee, "QCELP: The North American CDMA Digital Cellular Variable Rate Speech Coding Standard", IEEE Workshop on Speech Coding for Telecommunication, pp. 5–6 (1993).

*Primary Examiner*—David R. Hudspeth
*Assistant Examiner*—Martin Lerner
*Attorney, Agent, or Firm*—Wenderoth, Lind & Ponack, L.L.P.

[57] ABSTRACT

A noise codebook selects a code most suitable to the characteristics of an input speech vector from an inside quantification table. Furthermore, a codebook renewal circuit determines a correlative value between a noise code selected by the noise codebook and the input speech vector, subsequently calculates a multiplication value for each of noise codes to generate a renewal code by using the multiplication value with respect to the code selected most frequently by the coding processing at the time of voice. Renewal processing is preformed by replacing a desired code of the codebook with the renewal code. Furthermore, the renewal code is sent to a multiplexing circuit together with a renewal flag value to be sent to a decoding device by using the superfluous bit portion of an unvoice frame.

81 Claims, 23 Drawing Sheets

FIG. 18

| | | | | | | | | |
|---|---|---|---|---|---|---|---|---|
| Voice or unvoice flag | 1 bit | | | | | | | |
| Vocal tract (LSP) parameter | 39 bit | | | | | | | |
| Pitch filter parameter | 10 bit | | 10 bit | | 10 bit | | 10 bit | |
| Codebook parameter | 10 bit | 10 bit | 10 bit | 10 bit | 10 bit | 10 bit | 10 bit | 10 bit |
| One frame sum total | 160 bit | | | | | | | |

FIG. 19

| Voice or unvoice frames | Renewal frame |
|---|---|
| Voice | × |
| Unvoice | ○ |
| Voice | × |
| Voice | × |
| Voice | × |
| Unvoice | ○ |
| Unvoice | × |
| Unvoice | × |
| Voice | × |
| Unvoice | ○ |
| Unvoice | × |

FIG.20

| Voice or unvoice frames | Renewal frame |
|---|---|
| Voice | × |
| Unvoice | ○ |
| Voice | × |
| Voice | × |
| Voice | × |
| Unvoice | ○ |
| Unvoice | ○ |
| Unvoice | × |
| Voice | × |
| Unvoice | ○ |
| Unvoice | ○ |

CODING DEVICE AND DECODING DEVICE OF SPEECH SIGNAL, CODING METHOD AND DECODING METHOD

BACKGROUND OF THE INVENTION

1. Field of the Invention

The present invention relates to a technique for coding and decoding speech signals in a communication system such as, for example, a mobile communication system or the like.

2. Description of the Related Art

In a conversation on a telephone, time for speaking from a speaker and time for hearing speech from the other party, alternately exists. Here, when the speaker hears the voice of the other party of the communication, information sent to the other party becomes "unvoice. In other words, since they are not speaking not much information is required. Thus, there is proposed a variable rate type speech coding and decoding system which heightens a transmission rate at the time of voice (at the time of speaking), and which lowers the transmission rate at the time of listening (at the time of hearing the voice of the other party) (refer to the reference described below). According to this coding and decoding method, there is provided an advantage of lowering an average transmission rate while maintaining a speech quality.

Reference: DeJaco A., Gardner W., Jacobs P., Lee C. "QCELP": The North American CDMA Digital Cellular Variable Rate Speech Coding Standard", IEEE Workshop on Speech Coding for Telecommun., pp. 5–6 (1993).

The variable rate type coding and decoding method can provide a large advantage when using a transmission channel which allows a variable transmission volume. However, when a transmission channel having a fixed transmission volume is used, the amount of information transmitted by the transmission channel is small, a fixed amount of the transmission channel will be occupied with the result that there is no meaning in that the transmission channel is rendered variable.

Furthermore, in the speech coding and decoding method, a favorable speech quality can be obtained in the case where a correlation between the quantification code used in coding and the speech information is favorable while a sufficient speech quality can not be obtained in the case where the correlation is poor.

SUMMARY OF THE INVENTION

A first object of the invention is to obtain a favorable speech quality by occasionally renewing a code of the quantification table used for the quantification of voice information to improve the frequency characteristics at the time of voice by the unit of samples.

Furthermore, a second object of the invention is to transmit information for renewing a code of the quantification table from a coding device to a decoding device without lowering a transmission efficiency as speech information as a whole.

The present invention is to attain the aforementioned objects with a structure which will be described below.

(1) The coding device for speech signals according to the first aspect of the invention comprises a codebook for carrying speech coding processing at the time of voice of an input speech level by selecting from a quantification table a code most suitable to an input speech vector input from the outside, and a codebook renewal (or update) circuit for determining a relative value between a code selected by the codebook and the input speech vector, subsequently calculating a multiplication value of the relative value for each code to generate a renewal (or update) code by using the multiplication value with respect to the code selected most frequently by the coding processing at the time of voice which processing is carried out after the previous renewal (or update) processing thereby carrying out renewal processing by replacing this renewal code with a desired code of the codebook.

(2) The decoding device of speech signals according to a second aspect of the invention comprises a receiving circuit for picking up most suitable code information or a renewal code from received information input from the outside, and a codebook for carrying out decoding processing at the time of voice of the input speech vector by selecting a code corresponding to the most suitable code information from the quantification table for carrying out the renewal processing by replacing the renewal code with a desired code.

(3) A coding method for speech signals according to a third aspect of the invention comprises a coding processing process for coding the input speech vector at the time of voice by selecting a code most suitable to the input speech characteristics input from the outside from the quantification table, and a renewal (or update) processing process for determining a relative value between a code selected by a coding processing process and the input speech vector, subsequently calculating a multiplication value of the relative value for each code to generate a renewal (or update) code by using the multiplication value with respect to the code selected most frequently by the coding processing at the time of voice which processing is carried out after the previous renewal processing thereby carrying out renewal processing by replacing this renewal code with a desired code of the codebook.

(4) The decoding method for speech signals according to a fourth aspect of the invention comprises a receiving process for picking up most suitable code information or renewal (or update) code from received information input from the outside, a decoding process for decoding the input speech vector at the time of voice and a renewal (or update) process for renewing a desired code stored in the quantification table by replacing the code with the renewal code.

(5) According to each aspect of the invention, since the code of the quantification table used in the quantification of voice information can be occasionally renewed, the frequency characteristics at the time of voice can be improved by the unit of samples, and a noise can be reduced by improving speech sense.

(6) Furthermore, in the present invention, the renewal code can be transmitted from the coding device to the decoding device without deteriorating the transmission efficiency as speech information as a whole by transmitting the renewal code from the coding device to the decoding device by using surplus bits during unvoice frame.

BRIEF DESCRIPTION OF THE DRAWINGS

The foregoing and other objects, features and advantages of the present invention will be better understood from the following description taken in connection with the accompanying drawings, in which:

FIG. 18 is a table showing an example of a bit allotment of each parameter of the voice frame;

FIG. 19 is a concept view for explaining an example of a method for transmitting a renewal (or update) frame from the coding device to the decoding device in the first embodiment of the invention;

FIG. 20 is a concept view for explaining another example of transmitting the renewal frame from the coding device to the decoding device in the invention;

DESCRIPTION OF THE PREFERRED EMBODIMENTS

Figure 1:
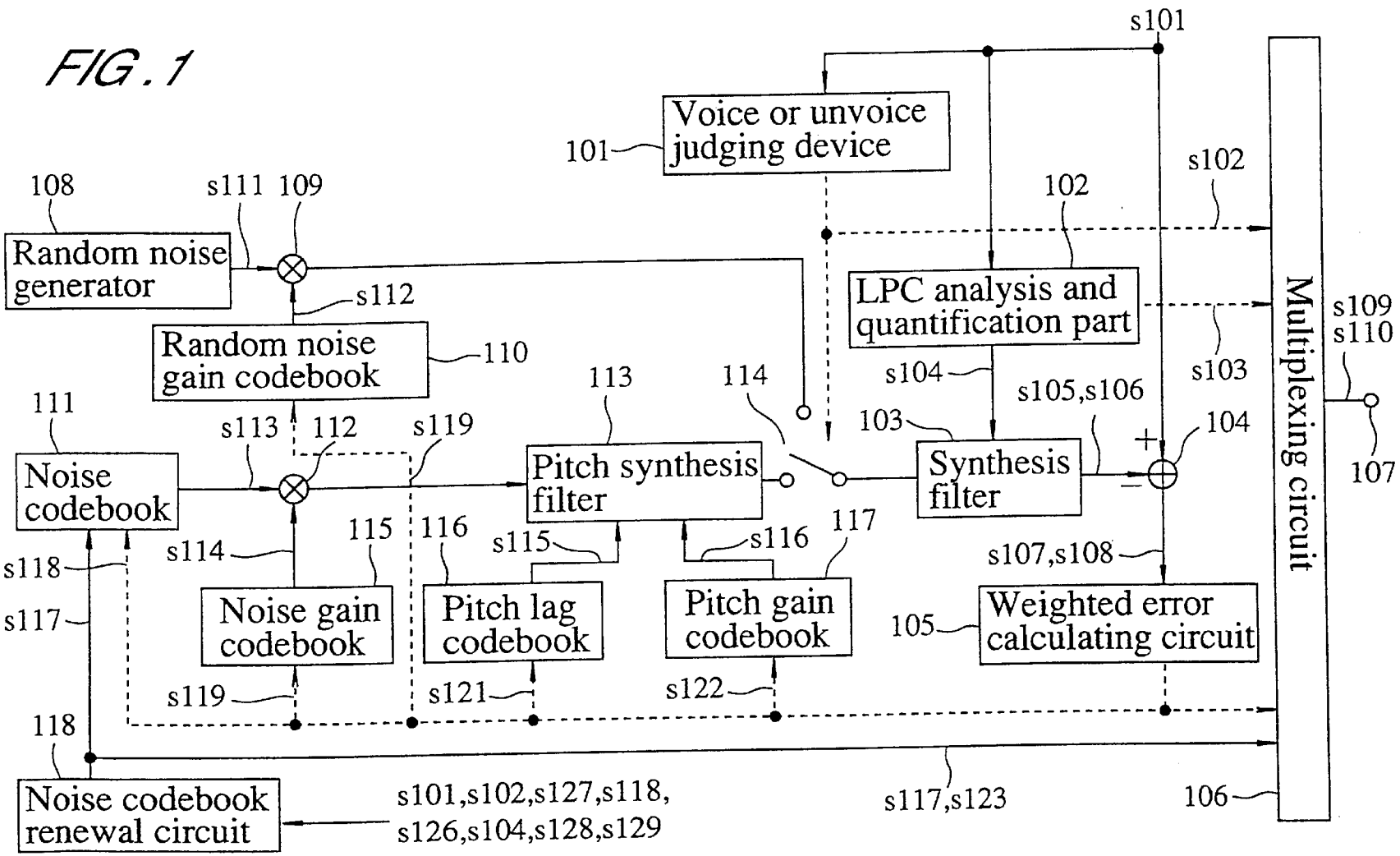
FIG. 1 is a block view of a coding device for coding speech signals according to a first embodiment of the invention.

Embodiments of this invention will be explained by using the drawings. Incidentally, in the drawings, a size of each constituent part, configuration and arrangement relations thereof are generally shown to an extent that this invention can be understood. Furthermore, it should be understood that value conditions explained hereinbelow are only an example.

Generally, in speech (or voice) synthesis, a synthesis speech is obtained by independently controlling a speech source part having information such as a pitch, a power and the like and a filter part having spectrum information showing phonemes. The filter corresponds to vocal tract or voice path of human beings. With respect to resonant speeches such as vowels or the like, a cyclic speech source is generated with a pulse generator, and with respect to non-resonant speeches, the non-cyclic speech source is generated with a noise generator thereby synthesizing a speech by driving a synthesis filter equivalent to the transmission characteristics of the voice path.

First Embodiment

A coding and a decoding device and a coding and a decoding method according to a first embodiment of the present invention will be explained by using the drawings.

In the beginning, the coding device according to the first embodiment will be explained.

As shown in FIG. 1, the coding device comprises respective blocks of a voice or unvoice judging device 101, an LPC (Linear Predictive Coding) analysis and quantification part 102, a synthesis filter 103, an adder 104, a weighted error calculating circuit 105, multiplexing circuit or multiplexer 106, a sending terminal 107, a random noise generator 108, a multiplication device 109, random noise gain codebook 110, a noise codebook 111, a multiplication device 112, a pitch synthesis filter 113, a switch 114, a noise gain codebook 115, a pitch lag codebook 116, a pitch gain codebook 117 and a noise codebook renewal circuit 118.

A function of the respective blocks will be explained.

An input speech (or voice) vector s101 is input to the voice or unvoice judging device 101 in the unit of frames. This input speech vector s101 is data indicative of a speech waveform and each frame comprises n sample values $\{y_i\}$, i=1, 2, . . . , n. The voice or unvoice judging device 101 compares a speech signal power (in other words, a vibration width of the speech waveform) represented by the input speech vector s101 with a threshold value. Then, when the speech power is larger than the threshold value, it is judged that the frame is the voice. On the other hand, when the input speech power is smaller than the threshold value it is judged that the frame is the unvoice. Furthermore, this voice or unvoice judging device 101 sets or resets the voice or unvoice flag s102 on the basis of this judgment result.

As the LPC analysis and quantification part 102, a device of a CELP (Code Excited Linear Predictive) type is used. To the LPC analysis and quantification part the input speech vector s101 is input in the unit of frames. Then, the speech path analysis (LPC analysis) and the quantification of the input speech represented by this input speech vector s101 is carried out with the result that an LPC index s103 which is data indicative of the quantification result is output to the multiplexing circuit 106 while at the same time LPC coefficient quantification value (in other words, linear predictive coefficients $\{\Delta i\}$, i=1, 2, . . . , p) s104 is output to the synthesis filter 103.

Here, the LPC analysis will be carried out in the following manner.

In a following equation (A), $y_n$ represents an arbitrary sample value of a speech waveform (obtained by the input speech vector s101) whereas $y_{n-1}, \ldots, y_{n-p}$ is p sample values prior to the sample value $y_n$ (the sample value in the previous frame will be used when the number of samples in the same frame is less than p). Furthermore, $\alpha_1, \alpha_2, \ldots, \alpha_p$ are coefficients. This equation (A) means that an arbitrary sample value $y_n$ can be made approximate to a multiplication of the previous sample values $y_{n-1}. \ldots, y_{n-p}$ and the coefficients $\alpha_1, a_2, \ldots, \alpha_p$. That is, the multiplication is a weighted average of the previous sample values or a linear combination thereof. In other words, according to the equation (A), it is possible to predict the sample value $y_n$ by using the previous sample values $y_{n-1}, \ldots, y_{n-p}$. Here, an error between the predicted value of $y_n$ and an actual measurement value differs in value depending on the aforementioned coefficients $\alpha_1, \alpha_2, \ldots, \alpha_p$. Then the coefficients $\alpha_1, \alpha_2, \ldots, \alpha_p$ which are present at the time when the average value of self-multiplication of this value assumes a minimum value (referred to as a minimum self-multiplication error) will be referred to as linear predictive coefficients, and a process for determining these linear predictive coefficients $\{\alpha i\}$, i=1, 2, . . . , p will be referred to as an LPC analysis (linear predictive analysis).

$$y_n=\alpha_1 y_{n-1}+\alpha_2 y_{n-2}+\ldots+\alpha_p y_{n-p} \tag{A}$$

The minimum self-multiplication error can be determined in the following manner. When the predicted value of the sample value $Y_n$ is set to $y'_n$, the following equation is provided.

$$y'_n=\alpha_1 y_{n-1}+\alpha_2 y_{n-2}+\ldots+\alpha_p y_{n-p} \tag{B}$$

Consequently, an error (predicted error) between the predicted value $y'_n$ and the actual measured value $y_n$ is set to $\epsilon_n$ this $\epsilon_n$ can be represented in the following equation (C).

$$\varepsilon_n = y_n - y'_n = y_n - \left(\sum_{i=1}^{p} \alpha_i y_{n-i}\right) \tag{C}$$

Here when the $-\alpha_i$ is replaced with $\alpha_i$, this predicted error can be represented with the following equation.

$$\varepsilon_n = y_n + \sum_{i=1}^{p} \alpha_i y_{n-i} = y_n + \sum_{i=0}^{p} \alpha_i y_{n-i} \qquad \alpha_0 = 1 \tag{D}$$

Therefore the self-multiplication average of the predicted error can be in the following equation (E).

$$\epsilon_n^2=(y_n+\alpha_1 y_{n-1}+\alpha_2 y_{n-2}+\ldots+\alpha_p y_{n-p})^2 \tag{E}$$

This means that the value is either a positive amount or 0. Unless there is only one extreme value, this is the minimum value. Consequently, a coefficient $\{\alpha i\}$ which renders the self-multiplication average of the predicted error minimum is determined as a solution to a simultaneous p-dimension equation in which a partial differential coefficient with respect to each $\alpha_i$ of the equation (E) is set to 0.

The synthesis filter 103 is a filter part (corresponding to a vocal tract or voice path of human beings) having spectrum information indicative of phonemes or speech units. At the time of voice, the adjustment by this voice path can be approximated by an all polar type or a zero pole type filter characteristic. This filter characteristic includes microscopic frequency characteristics (spectrum envelop characteristics) and radiation characteristics. Furthermore, at the time of unvoice, a synthesis speech vector s105 is obtained by the multiplication of a gain s112 with the vector s111 followed by the passage thereof through the synthesis filter 103.

As described above, this synthesis filter 103 receives or inputs the linear predictive coefficient $\{\alpha i\}$, (i=1, 2, . . . , p) as the LPC coefficient quantification value s104. Then a predetermined calculation process is carried out by using such linear predictive coefficients. Then the voice path characteristic H(z) shown in the following equation (F) is obtained by the z conversion of the calculation result.

$$H(z)=\epsilon(z)^{-1}y(z) \tag{F}$$

Then the synthesis speech vectors s105 or s106 are generated and output by the multiplication of this voice path H(z) with the data input via the switch 114.

The weighted error calculation circuit 105 receives an error vector s107 from the outside and calculates a weighted error Ewr [i] by using the error vector s107. Then this error calculation circuit 105 judges i at the time when the weighted error Ewr [i] becomes minimum, and this is output to the multiplexing circuit 106 as the most appropriate gain index s119.

The multiplexing circuit 106 judges, based on the voice or unvoice flag s102, whether the frame of the input speech vector s101 which is being carried out at the present time, is an unvoice frame or a voice frame. Then when it is judged that the frame is the unvoice frame, the multiplexing of the voice or unvoice flag value s102, the LPC index s103 and the most appropriate gain index s119 is performed to be output to the transmission channel as described later as a total code s109. On the other hand, in the case of the voice frame, the voice or unvoice flag value s102, the LPC index 103, the most appropriate gain index s119, the most appropriate noise code index s118 and the most appropriate pitch lag s121 and the most appropriate pitch gain s122 are multiplexed to be output to the transmission channel as described later as a total code s110.

Figure 9:
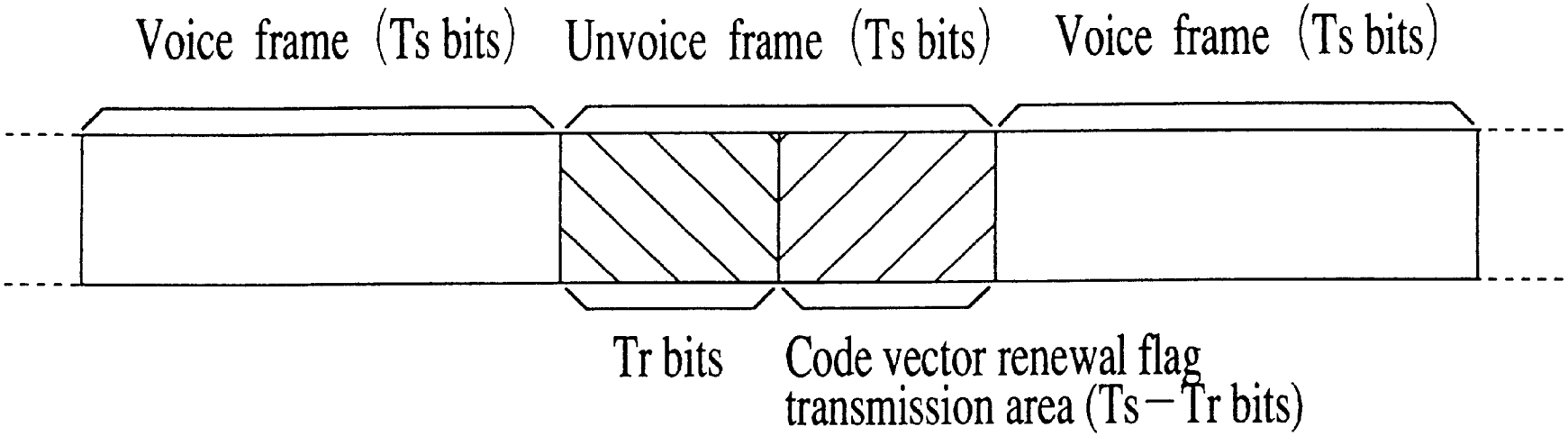
FIG. 9 is a concept view showing an example of a transmission method and voice and unvoice frame according to the first embodiment of the invention.

FIG. 9 conceptually shows an example of a transmission method of a voice frame and an unvoice frame. As shown in FIG. 9, the multiplexing circuit 106 transmits the total code s109 as the unvoice frame of the Ts bit, and the total code s110 as the voice frame of the Ts bit.

Furthermore, FIG. 18 shows a bit allotment of each parameter. In FIG. 18, LPC index s103 is transmitted as, for example, a 39 bit voice path parameter, the most appropriate pitch lag s121 and the most appropriate pitch gain as the pitch filter parameter, and the most appropriate noise code index s118 and the most appropriate gain index s119 as the codebook parameter.

The random noise generator 108 is a speech source for an unvoice part. The random noise code vector s111 output by the random noise generator 108 is generated by making the unvoice state approximate to the white color random noise corresponding to a disorders stream of air. Furthermore, the average energy of this random noise code vector s111 corresponds to a voice strength of human beings.

The random noise gain codebook 110 stores a random noise gain s112 (Gr [i](i=1 through N)).

Figure 10:
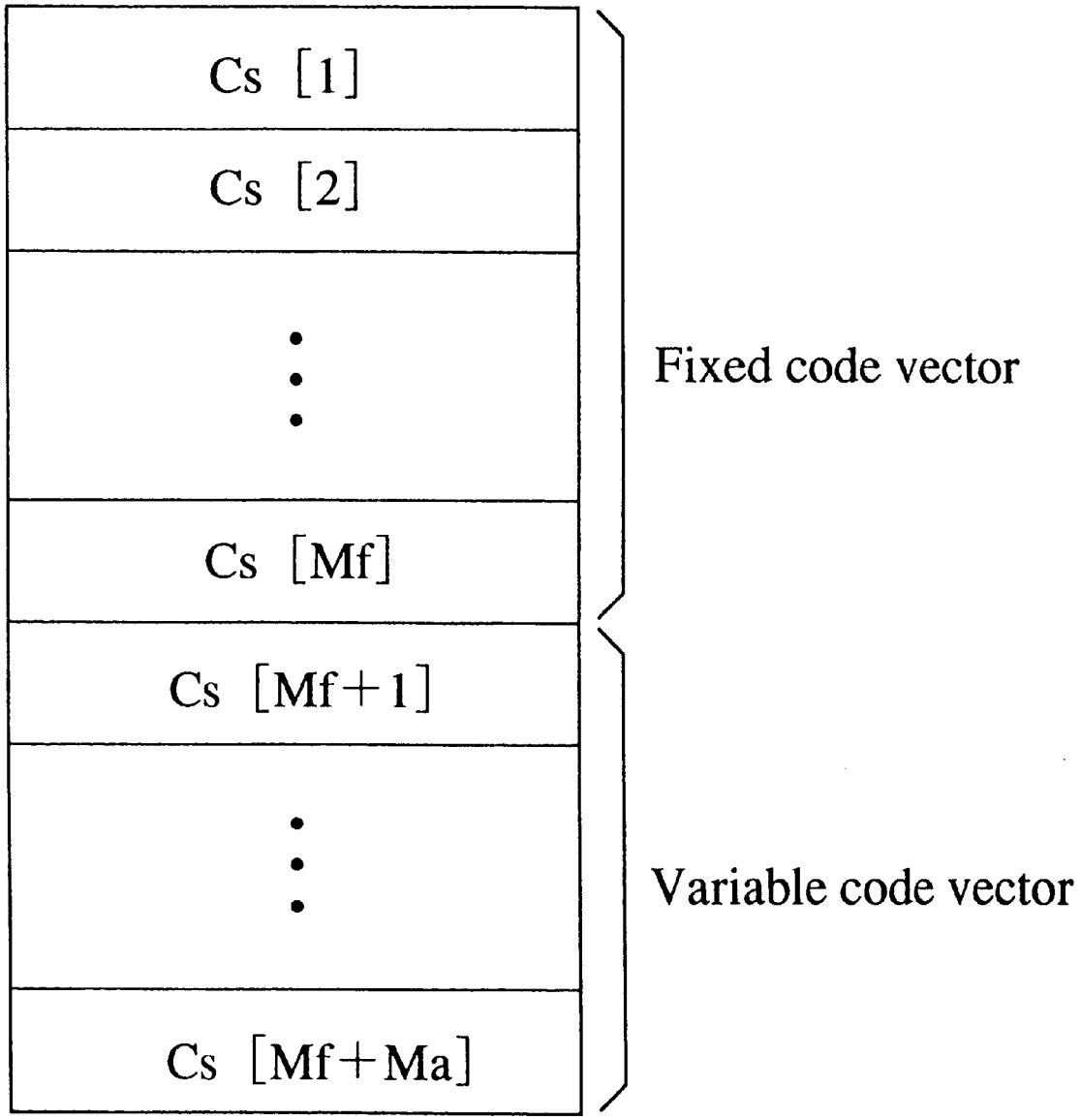
FIG. 10 is a concept view showing a structure of a quantification table for a noise codebook according to the first embodiment of the invention.

The noise codebook 111 is a speech source for a voice part. This noise codebook 111 stores a noise code vector s113 (Cs [j](j=1 through M)) which is a vector amount indicative of noises. This noise code vector s113 is renewed and transmitted to the decoding device as described later. FIG. 10 is a concept view showing the quantification table of the noise codebook 111. As shown in FIG. 10, $M_f$code vectors Cs [1] through Cs [$M_f$] out of the M (=$M_f$+$M_a$) code vectors are fixed vectors whereas $M_a$ code vectors Cs [$M_f$+1] through Cs [$M_a$+$M_a$] has a certain initial value, for example, a random noise.

The pitch synthesis filter 113 corresponds to a voice code of human beings, which gives a cycle to noises (in other words, noise code vector s113). This repetition cycle corresponds to a voice height while the peak value of the waveform corresponds to a voice strength.

The switch 114 is pressed down to the side of the random noise generator 108 when it is judged that the frame of the input speech vector which is currently processed by the voice or unvoice judging device 101 is the unvoice frame while the switch 114 is pressed to the side of the noise codebook 111 when it is judged that such frame is a voice frame.

The noise gain codebook 115 stores a gain s114 (Gs [k] (k=1 through X)) which is data of the scalar amount indicative of the noise gain.

The pitch lag codebook 116 stores a pitch lag s115 (L [m] (m=1 through Y)) which is data of the scalar amount indicative of the pitch cycle to be output to the pitch synthesis filter 113.

The pitch gain codebook 117 stores a pitch gain s116 (b [n] (n=1 through Z)) which is data of the scalar amount indicative of the degree of correlation to be output to the pitch synthesis filter 113.

The noise codebook renewal (or update) circuit 118 generates a noise vector for update or renewal by using a code vector which is most frequently selected out of the code vector Cs [$M_f$+1] Cs [$M_f$+$M_a$] (refer to FIG. 10) stored in the variable area of the noise codebook 111 to carry out the following calculation.

In the beginning, in the processing at the time of the speech presence, a correlative value with respect to the code vector selected by the voice frame is calculated. Then in the case where the voice frame continues, the correlative value is calculated for each of the code vectors of the continuing voice frames.

As a correlative calculation, for example, in the same manner as the LPC analysis and quantification part 102, there is a method for determining a minimum self-multiplication error. In this method, the correlative value s with respect to the input speech vector s101 is determined from (s1+s2+. . . +sn)/n by using an input signal s1, s2, . . . , sn of each frame (1 through n). A relative value H of an impact response matrix is determined from ($H_1$+$H_2$+. . . +$H_n$)/n by using an impulse response matrix $H_1$, $H_2$ , . . . , $H_n$ of each frame (1 through n). Here, the impact response matrix $H_1$, $H_2$, . . . , $H_n$ is an impulse response matrix representing a filter characteristics of the synthesis filter 103.

Here, the noise code vector for renewal is set to $C'_i$ the following equation (G) is provided.

$$S=H\cdot c'_i \tag{G}$$

From the equation (G), the following equation is provided.

$$c'_i=H^{-1}\cdot s \tag{H}$$

From the equation (H), the most appropriate code vector $C'_i$ is determined from the equation (H).

This code vector $C'_i$ can replace with the oldest vector in the variable vector.

An example of an operation at the time of the renewal (or update) of the code vector will be explained by using FIGS. 14 through 18. Incidentally, for the simplification of the explanation, the fixed code vector is set to four pairs while the variable code vector is set to one pair. Furthermore, these five sets of code vectors are in the two dimensions.

Figure 14:
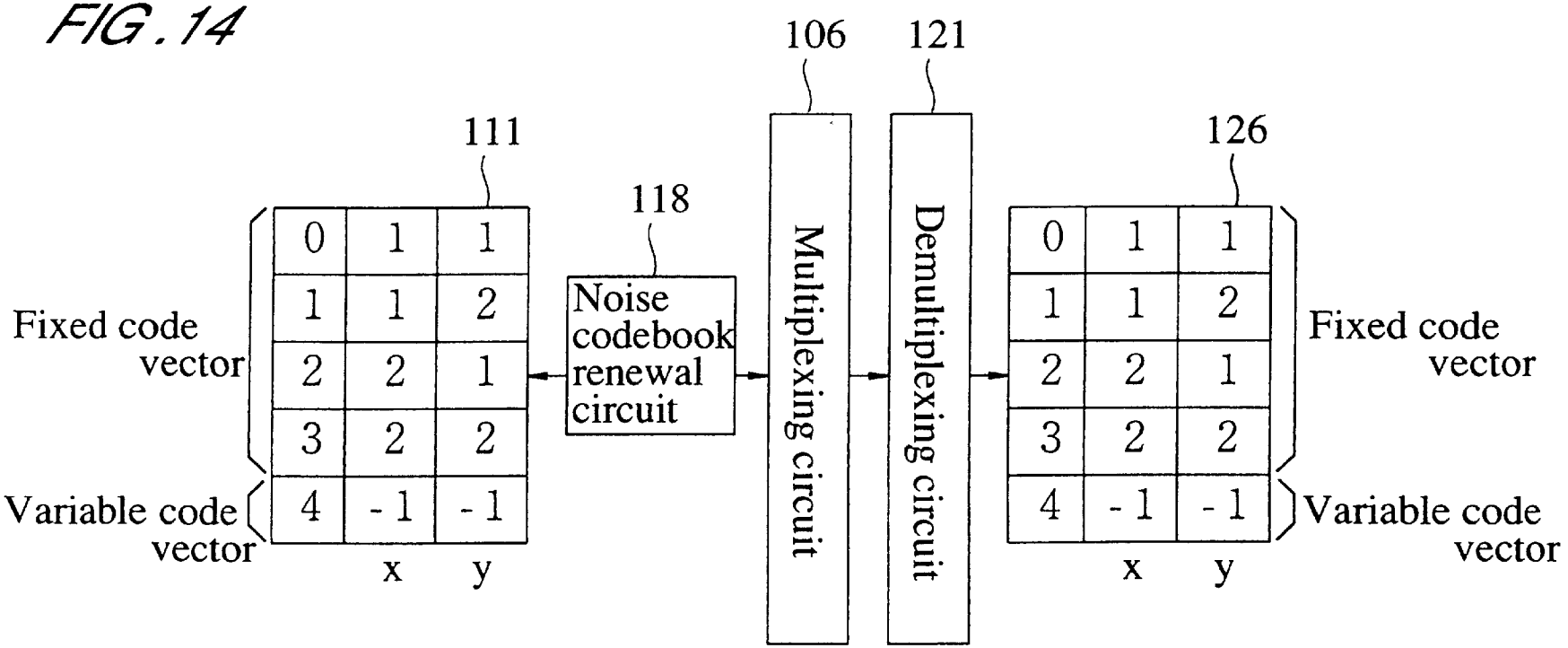
FIG. 14 is a concept view for explaining a transmission principle in the first embodiment of the invention.

FIG. 14 is a view showing a state of noise codebooks 111 and 126 of a coding device and a decoding device (which will be described later with reference to FIG. 2) at a certain time. As shown in FIG. 14, the quantification table in the noise codebook 111 stores (x, y)=(1, 1), (1, 2), (2, 1), (2, 2) as fixed code vectors 0, 1, 2, 3 and variable code vector (x, y)=(−1, −1), respectively.

Figure 15:
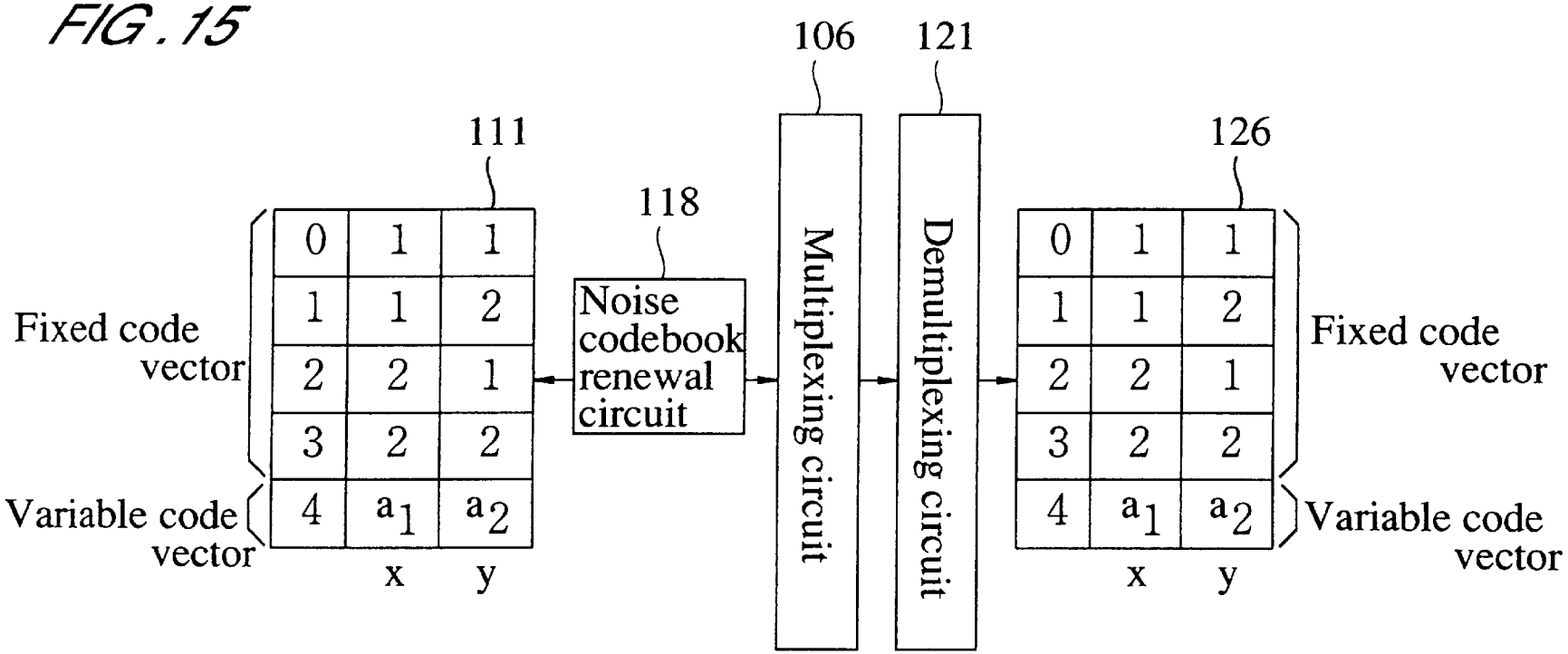
FIG. 15 is a concept view for explaining a transmission principle in the first embodiment of the invention.
Figure 16:
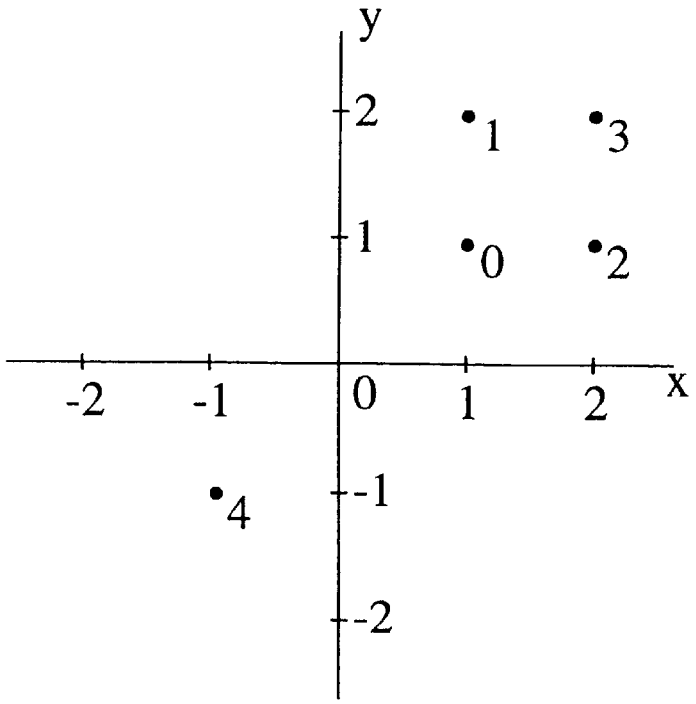
FIG. 16 is a distribution view for explaining a principle for the renewal of a noise code vector in the first embodiment of the invention.
Figure 17:
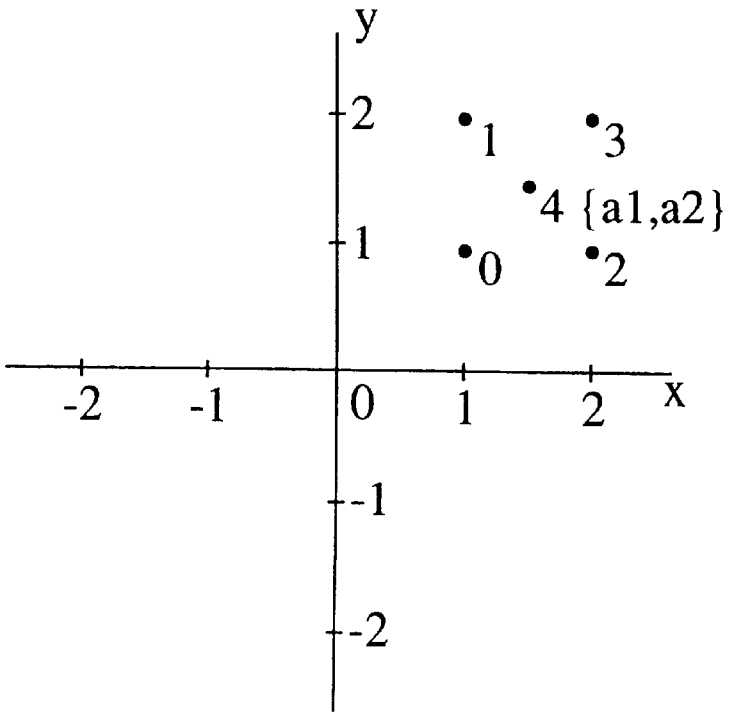
FIG. 17 is a distribution view for explaining a principle for the renewal of a noise code vector in the first embodiment of the invention.

FIG. 16 is a view showing a distribution state of a two dimensional code vector which is stored respectively in the noise codebooks 111 and 126 shown in FIG. 14. When it is supposed that a favorable correlation exists with respect to the input signal concerning the fixed code vectors 0 through 3 in FIG. 16, it is impossible to say that a favorable correlation does not exists with respect to the variable code vector 4. As a consequence, in the first embodiment, the noise codebook renewal circuit 118 (refer to FIG. 1) renews or updates the variable code vector 4 stored respectively in the noise codebooks 111 and 126 to a code vector having smaller quantification error. Here, as shown in FIG. 17, suppose that this variable code vector 4 is renewed or updated from (−1, −1) to (a1, a2). The variable code vector 4 after the renewal is transmitted to the noise codebook 126 via the multiplexing circuit 106 and the demultiplexing circuit (or demultiplexer) 121. With such a procedure, as shown in FIG. 15, the variable vector 4 within the noise codebooks 111 and 126 of the decoding device is renewed or updated from (−1, −1) to (a1, a2) respectively.

In this manner, in this embodiment, the variable code vector 4 is replaced with an appropriate vector at real times in accordance with the input speech vector s101. Furthermore, the variable code vector after the renewal is transmitted to the side of the decoding device (as described later, the vector is transmitted together with the change flag s123) so that more precise coding and decoding having fewer errors can be carried out by renewing or updating the noise codebook 126 of the decoding device in the same manner.

Furthermore, in the first embodiment, the renewed code vector is transmitted by using a surplus bit of the unvoice frame. As described above, in the case where the transmission volume of the transmission channel is fixed, a certain amount of transmission channel is occupied even in the case where the information amount transmitted through the transmission channel is smaller than the transmission volume. Then, when the information to be transmitted is the unvoice frame, information amount is smaller than the case of transmitting the voice frame so that the surplus bit is generated. In this embodiment, the surplus bit at the time of the unvoice frame transmission is utilized.

As shown in the aforementioned FIG. 9, the transmission volume at the time of sending the voice frame is the same as the information amount at the time of sending the unvoice frame so that Ts bit is provided in both cases. Furthermore, as shown in the aforementioned FIG. 18, information in the bit number which is the same as the transmission volume is transmitted in the case of transmitting the voice frame (FIG. 18 shows an example of Ts=160). On the other hand, the transmission volume required at the time of sending the unvoice frame is Tr bit (refer to FIG. 9), and is smaller than the transmission volume Ts bit so that the surplus bits (vacant volume) of Ts−Tr bits are generated. In the first embodiment, each of the code vectors 0, 1, 2, 3 and 4 is transmitted from the coding device to the decoding device by using this Ts–Tr bit area.

Next, the decoding device according to the first embodiment will be explained.

Figure 2:
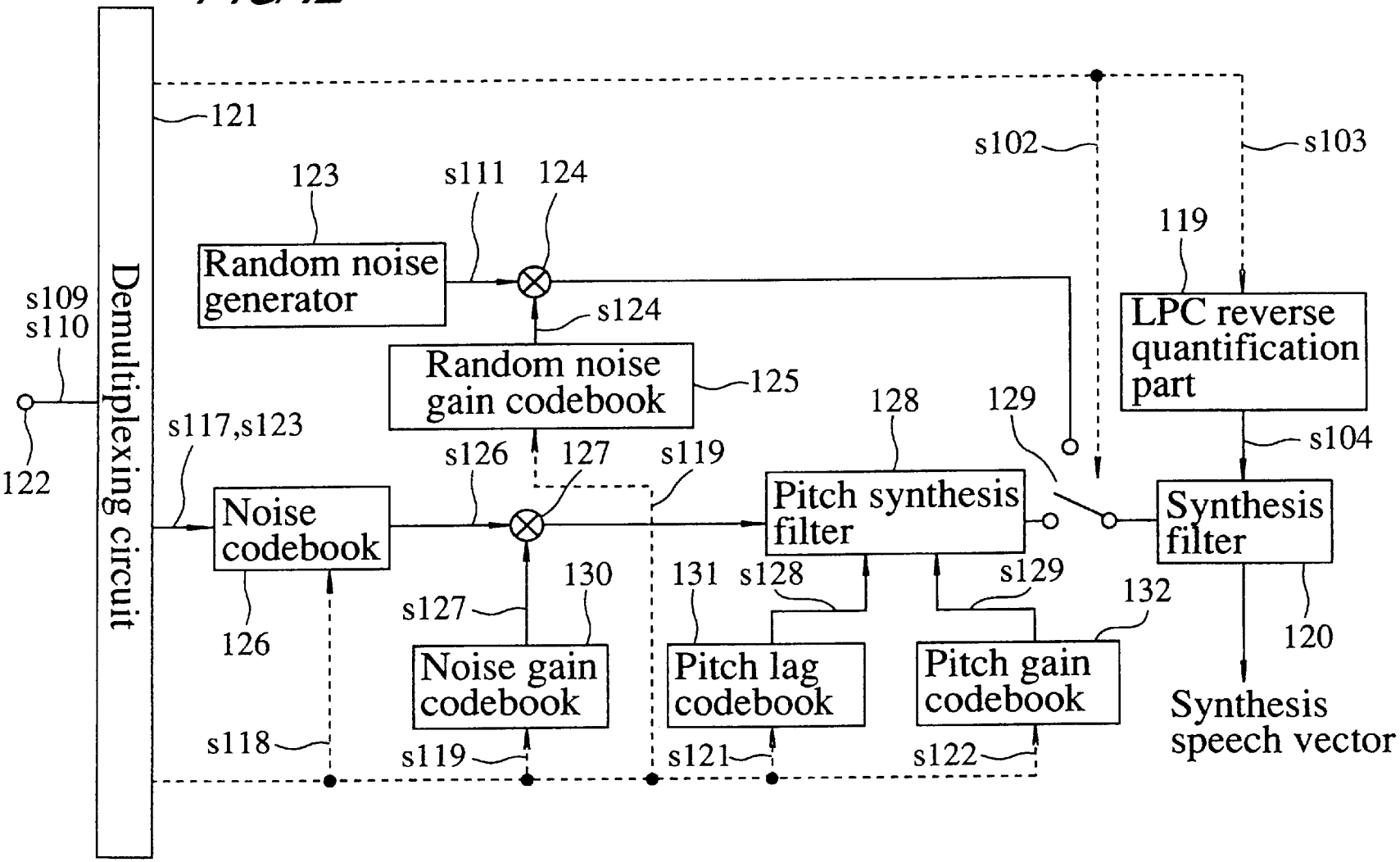
FIG. 2 is a block view of a decoding device for decoding speech signals according to the first embodiment of the invention.

As shown in FIG. 2, the decoding device comprises an input terminal 122, a demultiplexing circuit or demultiplexer 121, a random noise generator 123, a random noise gain codebook 125, a multiplication device 124, a noise codebook 126, noise gain codebook 130, a multiplication device 127, a pitch synthesis filter 128, a pitch lag codebook 131, a switch 129, an LPC reverse quantification part 119, and a synthesis filter 120.

A function of each of the blocks shown in FIG. 2 will be explained.

The demultiplexing circuit (demultiplexer) 121 receives a voice frame or an unvoice frame from the coding device via the input terminal 122. Then it is judged whether the frame which is input is an unvoice frame or a voice frame from the voice or unvoice flag s102 which constitutes a part of the information of this frame. Then in the case where this frame is the unvoice frame (in other words, in the case where the information in this frame is a total code s109), the information in this frame is demultiplexed or separated into the voice or unvoice flag values s102, the LPC index s103, the most appropriate gain index s119 or the like. On the other hand, in the case where the input frame is the voice frame (in other words, in the case where the information in this frame is the total code s110), the information in this frame is demultiplexed or separated into the voice or unvoice flag value s102, the LPC index s103, the most appropriate gain index s119, the most appropriate noise code index s118, the most appropriate pitch lag s121, the most appropriate pitch gain s122 and the like.

The LPC reverse quantification part 119 uses the LPC index s103 to calculate the quantification value s104 of the LPC coefficient.

The switch 129 is pressed down to the side of the noise codebook 126 in the case where the voice or unvoice flag s102 input from the demultiplexing circuit 121 is the voice frame whereas the switch 129 is pressed down to the side of the random noise generator 123 in the case where the voice or unvoice flag s102 is the unvoice frame.

The noise codebook 126 stores the noise code vector which is the data of the vector amount representing the noise. Furthermore, the noise code vector s117 for renewal or update and the renewal (or update) flag s123 are input from the demultiplexing circuit 121 so that noise code vector stored in the inside quantification table is renewed or updated on the basis of these information items s117 and s123.

The noise gain codebook 130 stores the noise gain which is a scalar amount representing the noise gain.

The pitch synthesis filter 128 corresponds to a voice (or vocal) code of human beings, and gives a cycle to the noise (in other words, the noise code vector s113). This repetition cycle corresponds to the height of the voice (pitch cycle) while the peak value of the waveform corresponds to the height of the voice.

The pitch lag codebook 131 stores a pitch lag which is the data of the scalar amount representing the pitch cycle.

The random noise generator 123 is an unvoiced speech source, and stores random noise code vectors.

The pitch gain codebook 132 stores the pitch gain which is the data of the scalar amount representing a degree of the long correlation.

The random noise gain codebook 125 stores the random noise gain s124 which is the scalar amount representing the gain of the random noise.

The synthesis filter 120 generates a synthesis speech vector. This synthesis speech vector is spectrum information representing the phoneme or speech item, and this synthesis filter 120 corresponds to the voice path or vocal tract of human beings.

Next, an overall operation of the coding device and the decoding device will be explained.

In the beginning, as described above, the LPC analysis and quantification part 102 of the coding device calculates the quantification value s104 of the LPC coefficient and the LPC index s103 by using the input speech vector s101 input in the unit of frames to be output to the synthesis filter 103 and the multiplexing circuit (multiplexer) 106.

Along with this, as described above, the voice or unvoice judging device 101 receives the input speech vector s101 in the unit of frame so that it is judged whether such frame is the voice frame or the unvoice frame.

Then, in the case where it is judged that such frame is the unvoice frame, this voice or unvoice judging device 101 sets the voice or unvoice flag to the "unvoice" to output this flag value s102 to the multiplexing circuit 106 while at the same time pressing the switch 114 to the side of the random noise generator 108. Subsequently, the random noise generator 108 outputs the random noise code vector s111. Then, at the same time, the random noise gain codebook 110 outputs the random noise gain s112 (Cr[i](i=1 through N)). The multiplication device 109 sends the result of the multiplication of the random noise gain s112 with the random noise code vector s111 to the synthesis filter 103 via the switch 114. Then, the synthesis filter 103 generates the aforementioned synthesis speech vector s105. The adding device 104 calculates the error vector s107 by subtracting the synthesis speech vector s105 from the input speech vector s101. The weighted error calculation circuit 105 calculates the weighted error Ewr [i] by using this error vector s107, judges the i which renders minimum this weighted error Ewr [i], and further sends this judgment result to the multiplexing circuit 106 as the most appropriate gain index s119. Then, the multiplexing circuit 106 multiplies the aforementioned voice or unvoice flag s102, the LPC index s103 and the most appropriate gain index s119. Furthermore, at this time, the multiplexing circuit 106 multiplies the noise code vector s117 generated by the noise codebook renewal circuit 118 and the renewal flag s123. Then, the multiplied data is output to the transmission channel as the total code s109. Incidentally, an operation of generating the noise code vector s117 and the renewal flag s123 by the noise codebook renewal circuit 118 will be described later.

On the other hand, the voice or unvoice judging device 101 judges that the frame of the input speech vector s101 is the voice vector, the voice or unvoice judging device 101 sets the voice or unvoice flag to voice so that the flag value s102 is output to the multiplexing circuit 106 while, at the same time, the switch 114 is pressed down to the side of the noise codebook 111. Subsequently, the noise codebook 111 outputs the noise code vector s113 (Cs [j] 1 through M)). The noise gain codebook 115 outputs the gain s114 (Cs [k] (k=1 through x)). Then, the multiplication device 112 sends the result of multiplication of the noise code vector s113 and the gain s114 to the pitch synthesis filter 113. On the other hand, the pitch lag codebook 116 outputs the pitch lag s115 (L [m] (m=1 through Y) to the pitch synthesis filter 113. Furthermore, the pitch gain codebook 117 outputs the pitch gain s116 (b [n] (n=1 through Z)) to the pitch synthesis filter 113. Then, the pitch synthesis filter 113 gives a cycle to the noise code vector s113 in the aforementioned manner, and then sends it to the synthesis filter 103. The synthesis filter 103 generates the synthesis speech vector s106 (Ss [j, k, m, n]) in the aforementioned manner. Subsequently, the adding device 104 generates the error vector s108 (Es [j, k, m, n]) by subtracting the synthesis speech vector s106 from the input speech vector s101. Subsequently, after the weighted error calculating circuit 105 generates the weighted error Ews [j, k, m, n] , this overlapping error Ews [j, k, m, n] judges a combination of j, k, m and n which becomes the minimum. Then the value j obtained as a result of this judgment is sent to the noise codebook 111 as the most appropriate noise code index s118, and the value k obtained as a result of judgment is sent to the noise gain codebook 115 as the most appropriate gain index s119. Then the value m obtained as a result of judgment is sent to the pitch lag codebook 116 as the most appropriate pitch lag s121. Furthermore, the value n obtained as the result of judgment is sent to the pitch gain codebook 117 as the most appropriate pitch gain s122. Furthermore, these data items s118, s119, s121 and s122 are also sent to the multiplexing circuit 6. After that, the multiplexing circuit 106 mutiplexes the voice or unvoice flag s102, the LPC index s103, the most appropriate noise code index s118, the most appropriate gain index s119, the most appropriate pitch lag s121 and the most appropriate pitch gain s122 to be output to the transmission channel as a total code s110.

Figure 21:
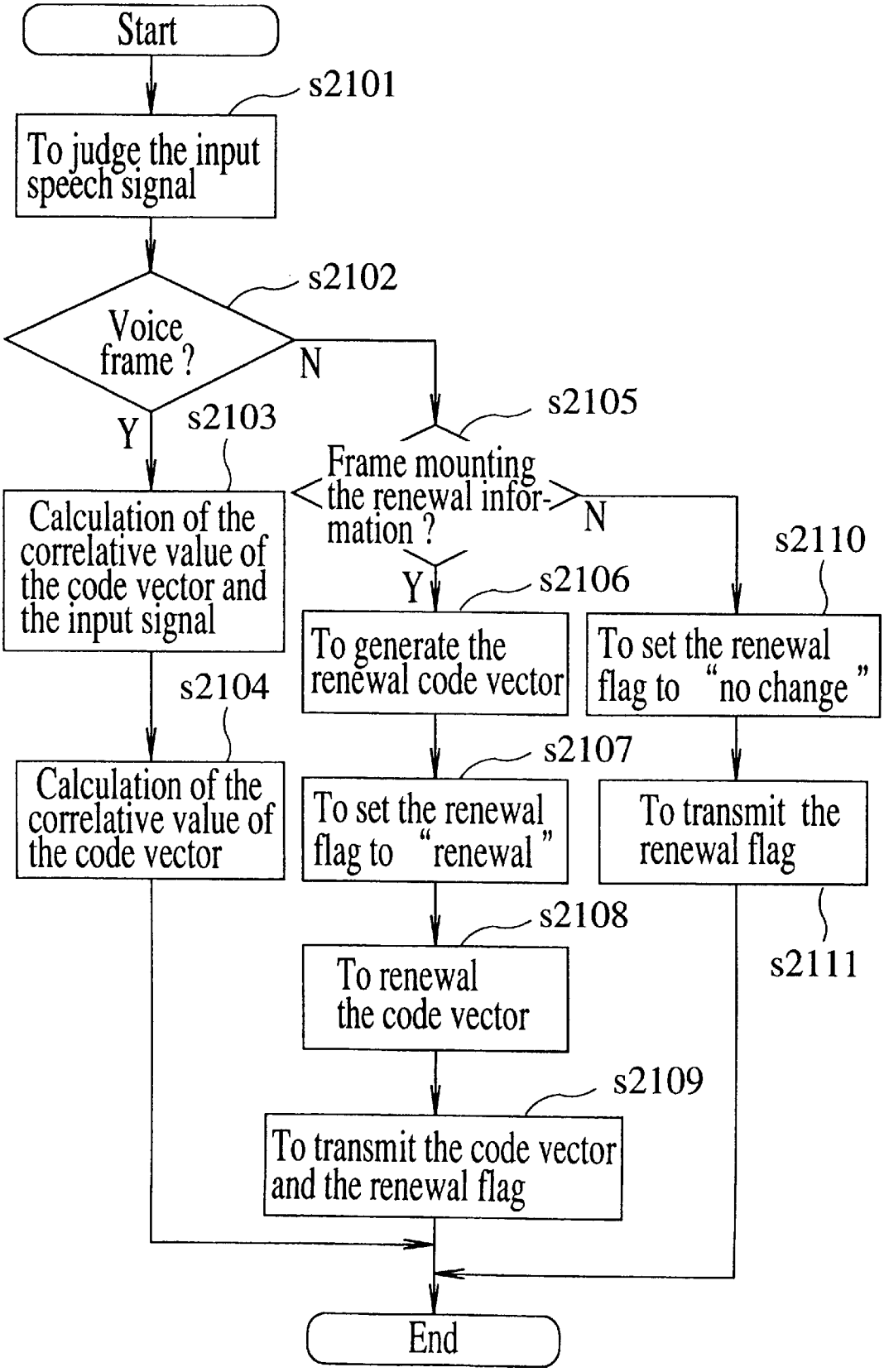
FIG. 21 is a flowchart showing a code vector renewal (or update) method according to the first embodiment of the invention.

Next, the operation of renewing or updating the noise code vector of the noise codebook 111 by using the noise codebook renewal circuit 118 will be explained by using a flowchart of FIG. 21.

In the beginning, in the case where the voice or unvoice judging device 101 judges that the frame of the input speech vector s101 is the voice frame (step s2101, step s2102), the noise codebook renewal circuit 118 calculates a correlation between the selected code vector and the input speech vector s101 (step s2103). Then, the calculation result is further multiplied by the multiplication value of the calculation result up to the previous calculation process (step s2104). As a consequence, in the case where the voice frame continues as the frame of the input speech vector s101, the correlative value with respect to each code vector will be subsequently multiplied.

On the other hand, in the case where it is judged at step s2101 and step s2102 that the input speech vector s101 is the speech frame, it is judged that the previous judgment result is the voice frame or the unvoice frame (in other words, the frame is the unvoice frame for mounting the renewal code vector s117 or the frame for not mounting the renewal code frame 117) (step s2105).

Then, in the case where it is judged that the frame is the unvoice frame for mounting the renewal code vector s117, the code vector is judged which is most frequently selected in each of the voice frame from the mounting of the previous renewal code vector s117 to the present unvoice frame. Furthermore, by using the multiplication result obtained at the aforementioned step s2104, the renewal noise code vector s117 is calculated (step s2106). Then the renewal flag s123 is set to the "renewal" or "update" (step s2107). Subsequently, the noise code vector of the noise codebook 111 is renewed or updated by replacing the renewal code vector s117 with the oldest vector among $M_a$ variable vectors (step s2108). Furthermore, at the same time, the renewal code vector s117 and the renewal flag s123 are sent to the multiplexing circuit 106. The multiplexing circuit 106 uses the surplus bit of the unvoice flag to transmit these data items s117 and s123 to the side of the decoding device (step s2109).

On the other hand, at step s2105, it is judged that the frame is the unvoice frame for not mounting the renewal code vector s117, the renewal flag is set to "no change" (s2210) followed by sending the renewal flag value s123 to the multiplexing circuit 106. In this case, the multiplexing circuit 106 uses the surplus bit of the unvoice flag to this renewal flag value s123 (step s2111).

FIG. 19 is a concept view for explaining a classification of a case in which the renewal code vector s117 is mounted on the frame and a classification of a case in which the frame is not mounted. In FIG. 19, symbol ○ denotes a frame for mounting the renewal code vector s117 while symbol X denotes a renewal code vector s117. In this manner, in the case where the unvoice frame continues, the renewal code vector s117 and the renewal flag value s123 are transmitted in the first unvoice frame and only the renewal flag value s123 is transmitted in the unvoice frame after the second process.

Next, an overall operation of the decoding device will be explained.

When the total code s109 and s110 as described above is input from the input terminal 122, the demultiplexing circuit 121 demultiplexes or separates this total code s109 or s110.

Then, in the case where the voice or unvoice flag s102 input from the coding device is speech presence, the decoding device carries out the following operation.

In the beginning, the LPC reverse quantification part 119 uses the LPC index s103 input from the demultiplexing circuit or separation circuit 121 to calculate the LPC coefficient quantification value s104. Furthermore, the switch 129 is pressed down to the side of the noise codebook 126 with the voice or unvoice flag s102. Next, the noise codebook 126 receives the most appropriate noise code index s118 from the demultiplexer 121 and outputs the noise code vector s126 corresponding thereto. Furthermore, the noise gain codebook 130 receives the most appropriate gain index s119 from the demultiplexer 121 and outputs the noise gain s127 corresponding thereto. Furthermore, the pitch lag codebook 131 outputs the pitch lag s128 corresponding to the most appropriate pitch lag s121 input from the demultiplexing circuit 121 to the pitch synthesis filter 128. In the similar manner, the pitch gain codebook 132 outputs the pitch gain s129 corresponding to the most appropriate pitch gain input from the demultiplexing circuit 121 to the pitch synthesis filter 128. The noise code vector s126 output by the noise codebook 126 is multiplied by the noise gain with the multiplication device 127 followed by being given a cycle with the pitch synthesis filter 128 to be input to the synthesis filter 120 via the switch 129. Then, the synthesis filter 120 uses the LPC coefficient quantification value s104 input from the LPC reverse quantification part 119 and the noise code vector s126 input from the pitch synthesis filter 128 to generate a synthesis speech vector.

On the other hand, in the case where the voice or unvoice flag s102 input by the coding device is the unvoice, the decoding device carries out the following operation.

In the beginning, the LPC reverse quantification part 119 calculates the LPC coefficient quantification value s104 by using the LPC s103 input from the demultiplexing circuit 121. The switch 129 is pressed down to the side of the random noise generator 123 with the voice or unvoice flag s102. The random noise generator 123 outputs a random noise code vector s111. The random noise codebook 125 receives the most appropriate gain index s119 from the demultiplexer 121 and outputs the random noise gain s124 corresponding to the index s119. As a consequence, after the random noise code vector s111 is multiplied by the most appropriate gain index s119 with the multiplication device 124, the random noise code vector s111 is input to the synthesis filter 120 via the switch 129. Then the synthesis filter 120 generates a synthesis speech vector by using the LPC coefficient quantification value s104 and the random noise code vector s111 to generate the synthesis speech vector.

Furthermore, in the case where the voice or unvoice flag s102 is the unvoice, the noise codebook 126 receives the renewal flag value s123 from the demultiplexing circuit 121. Then, in the case where the renewal flag value s123 indicates the "renewal" or "update", the noise code vector s117 is subsequently input to the noise codebook 126 to renew or update the noise code vector s117. In the same manner as the coding device, the noise code vector of the noise codebook 126 is renewed or updated. On the other hand, in the case where the renewed flag value s123 indicates "no change", the noise codebook 126 does not renew the noise code vector.

As explained above, in the first embodiment, the noise codebook renewal circuit 118 is used to frequently renew the noise code vector stored in the noise codebook 111 of the coding device and the noise codebook 126 of the decoding device with the result that the frequency characteristics at the time of voice can be improved in the unit of samples, and the noise can be decreased and the noise is improved to reduce the noise.

Furthermore, the noise code vector s117 for the renewal is sent to the decoding device from the coding device by using the surplus bit of the unvoice frame so that the transmission channel can be efficiently used and the transmission speed as a whole can not be affected.

Second Embodiment

Next, a second embodiment of this invention will be explained. In the second embodiment, the gain code (scalar amount) is stored in the noise gain codebook.

Figure 3:
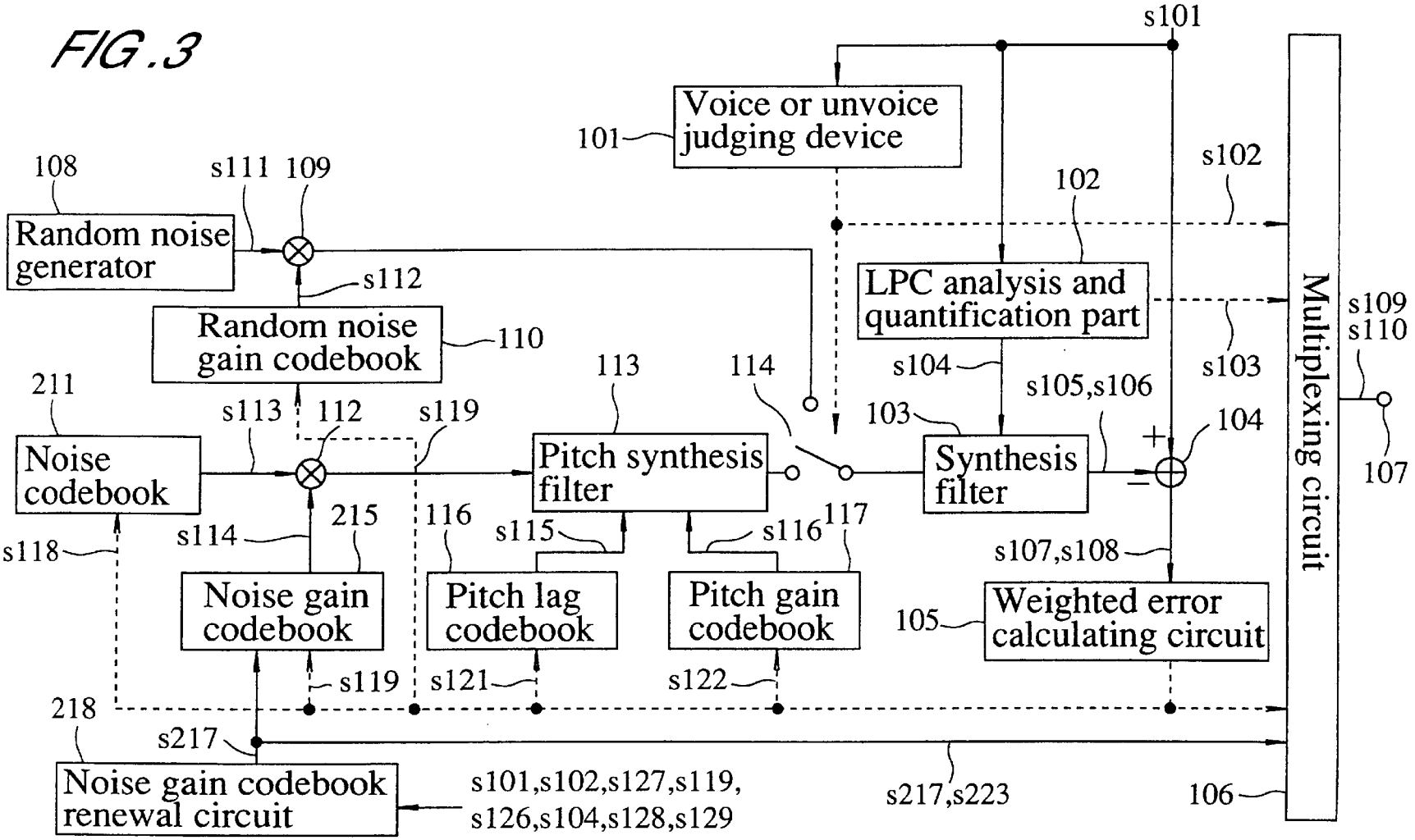
FIG. 3 is a block view of a coding device for coding speech signals according to a second embodiment of the invention.

FIG. 3 conceptually shows a structure of a coding device according to the second embodiment.

As shown in FIG. 3, this coding device comprises respective blocks of a voice or unvoice judging device 101, an LPC analysis and quantification part 102, a synthesis filter 103, an adding device 104, a weighted error calculating circuit 105, multiplexing circuit (multiplexer) 106, a sending terminal 107, a random noise generator 108, a multiplication device 109, a random noise gain codebook 110, a noise codebook 211, a multiplication device 112, a pitch synthesis filter 113, a switch 114, a noise gain codebook 215, a pitch lag codebook 116, a pitch gain codebook 117 and a noise gain codebook renewal (or update) circuit 218.

In FIG. 3, the function of the blocks having the same reference numeral with FIG. 1 is almost the same as the case of FIG. 1, so an explanation thereof will be omitted.

The noise codebook 211 stores only a fixed code vector, and does not store the variable vector. In this point, the noise codebook 211 is different from the case of the noise codebook 111 of FIG. 1 (refer to FIG. 10). This is because in the second embodiment, the code vector stored in the noise codebook 211 is not renewed (updated).

Figure 11:
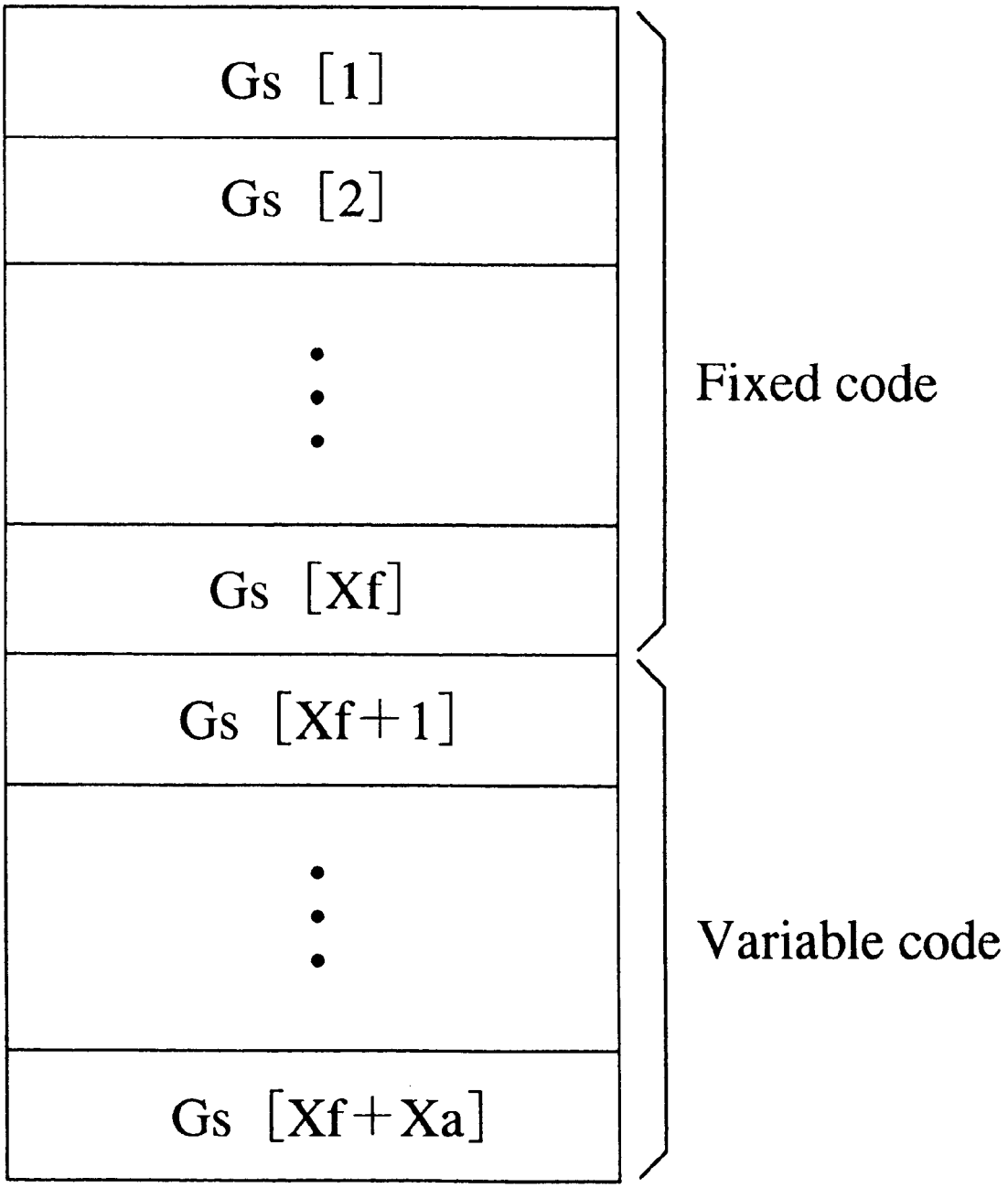
FIG. 11 is a concept view showing a structure of the quantification table for a noise gain codebook according to the first embodiment of the invention.

The noise gain codebook 215 also stores the $X_a$ variable codes (these codes are both scalar amounts), in addition to $X_f$ fixed codes unlike the case of the first embodiment. FIG. 11 is a concept view showing the quantification table of this noise gain codebook 215. As shown in FIG. 11, $X_f$ code vectors. Gs[1] through Gs[$X_f$] out of X(=$X_f$+$X_a$) code vectors are fixed vectors while $X_a$ code vectors Gs[$X_f$+1] through Gs[$X_f$+$X_a$] are variable vectors. The variable vectors Gs[$X_f$+1] through Gs[$X_f$+$X_a$] have a certain initial value.

Furthermore, the coding device according to the second embodiment is provided with a noise gain codebook renewal (or update) circuit 218. This noise gain codebook renewal circuit 218 renews or updates the variable code of the noise gain codebook 215. A principle of generating the new gain code s217 for renewal is the same as the case of the noise codebook renewal circuit 118 shown in FIG. 1. In other words, the correlative value of the voice frame of the input speech vector s101 is subsequently calculated. By using the multiplication value of these correlative values, a new gain code s217 can be generated.

A method for transmitting the gain code s217 for renewal is the same as the case of the aforementioned first embodiment. A principle of generating a new gain code s217 is the same as the case of the noise codebook renewal circuit 118 shown in FIG. 1. In other words, with the use of the surplus bit of (Ts−Tr) bit generated when the unvoiced speech frame is transmitted as the total code s109, the renewal gain code 217 and the renewal flag value s225 are transmitted to the decoding device.

Figure 22:
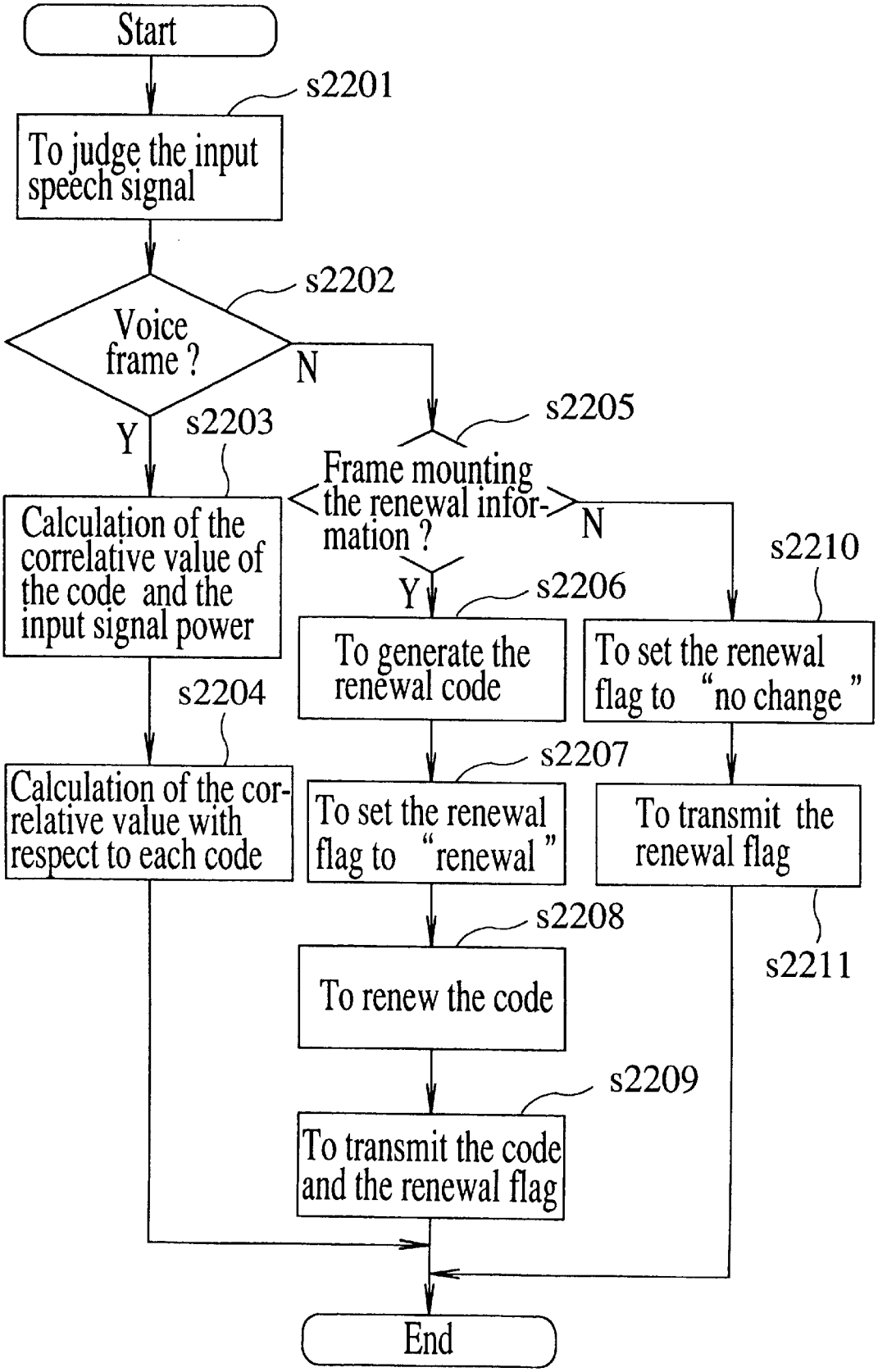
FIG. 22 is a flowchart showing a code renewal method according to the second embodiment of the invention.

An operation of renewing the gain code of noise gain codebook 215 by using the noise gain codebook renewal circuit 218 will be explained by using a flowchart shown in FIG. 22.

In the beginning, in the case where the voice or unvoice judging device 101 judges that the frame of the input speech vector s101 is the voice Fame (step s2201, s2202), the noise gain codebook renewal circuit 218 calculates a correlation between the selected gain code and the input speech vector s101 (step s2203). Then, the calculation result is further multiplied by the multiplication value of the calculation result up to the previous process (step s2204). In the case where as the frame of the input speech vector s101 the voice frame continues, the correlative value of each gain code will be subsequently calculated.

On the other hand, in the case where the input speech vector s101 is the unvoice frame at steps s2201 and s2202, it is subsequently judged whether the previous judgment result was the voice frame or the unvoice frame (in other words, whether the frame is the unvoice frame for mounting the renewal gain code s217 or the frame for not mounting the unvoice frame)(s2205). Then, in the case where it is judged that the frame is the unvoice frame for mounting the renewal gain code s217, the gain code having the largest selection frequency in each of the voice frame from the mounting of the previous renewal gam code s217 up to the unvoice frame at this time. Furthermore, by using the multiplication result obtained at the aforementioned step s2104, the renewal gain code s217 is calculated (step s2206). Then the renewal flag s223 is set to the "renewal" or "update" (step s2207). Furthermore, at the same time, the renewal gain code s217 is replaced with the oldest gain code among $M_a$ variable vectors to renew the gain code of the noise gain codebook 215 (step s2208). Furthermore, at the same time, the renewal new gain code s217 and the renewal flag s223 are sent to the multiplexing circuit 106. The multiplexing circuit (multiplexer) 106 uses the surplus bit of the unvoice flag, as described above, to transmit these data items s217 and s223 to the side of the decoding device (step s2209).

On the other hand, in the case where it is judged at step s2205 that the frame is the unvoice frame for not mounting the renewal gain code s217, the renewal flag is set to "no change" (step s2210), this renewal flag value s223 is sent to the side of the multiplexing circuit 106. In this case, the multiplexing circuit 106 uses the surplus bit of the unvoice flag to send the renewal flag value s223 (step s2211).

Incidentally, since an operation of the other constituent elements are almost the same as the first embodiment, an explanation thereof will be omitted. However, the second embodiment is different from the first embodiment in that the code vector stored in the noise codebook 211 is not renewed.

Figure 4:
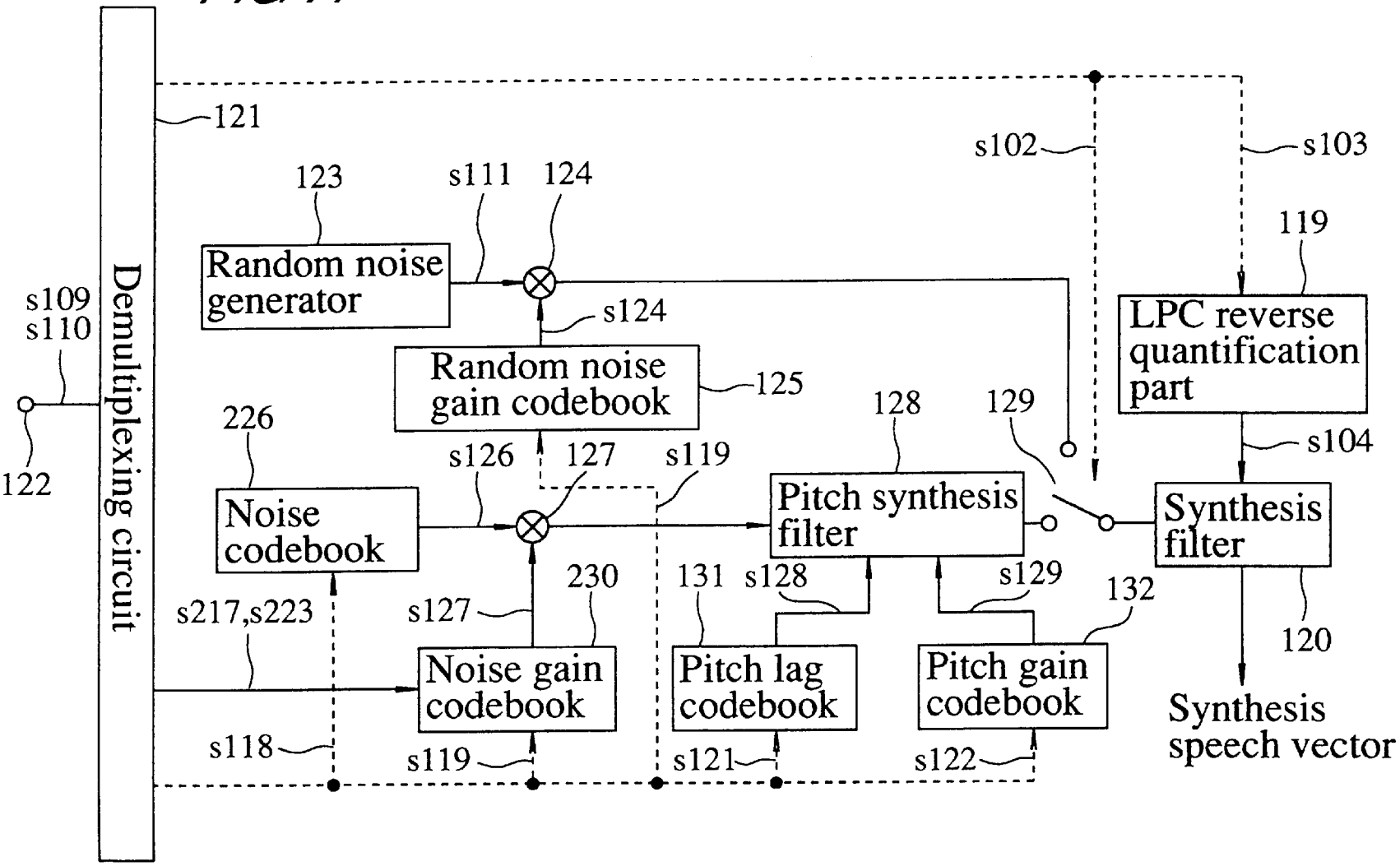
FIG. 4 is a block view of a decoding device for decoding speech signals according to the second embodiment of the invention.

FIG. 4 conceptually shows a structure of the decoding device according to the second embodiment of the invention. As shown in FIG. 4, this decoding device comprises an input terminal 122, a demultiplexing circuit (demultiplexer) 121, a random noise generator 123, a random noise gain codebook 125, a multiplication device 124, a noise codebook 226, a noise gain codebook 230, a multiplication device 127, a pitch synthesis filter 128, a pitch lag codebook 131, a pitch gain codebook 132, a switch 129, an LPC reverse quantification part 119 and a synthesis filter 120.

In FIG. 4, a function of blocks having the same reference numeral as FIG. 2 is almost the same as the case of FIG. 2, so an explanation thereof will be omitted.

The noise codebook 226 is different from the noise codebook 126 of FIG. 2 in that the noise codebook 226 stores only fixed code vectors and the noise codebook 226 does not store the variable code vectors. This is because the code vector stored in the noise codebook 226 is not renewed (updated) in the second embodiment.

The noise gain codebook 230 is different from the case of the first embodiment in that the noise gain codebook 230 stores $X_a$ variable codes (these codes are all scalar amount) in addition to $X_f$ fixed codes.

An operation of the decoding device will be explained hereinbelow.

In the beginning, the demultiplexing circuit, that is, demultiplexer 121 receives the total codes s109 or s110 from the input terminal 122 to demultiplex or separate this total code s109 or s110.

Then, in the case where the voice or unvoice lag s102 is the "unvoice", the noise gain codebook 230 receives the renewal flag value s223 from the demultiplexing circuit 121. Then, in the case where this renewal flag value s223 indicates "renewal", the noise gain code s217 is input to renew or update the gain code of the noise gain codebook 230 in the same manner as the case of the coding device. On the other hand, in the case where renewal flag value s223 indicates "no change", the noise gain codebook does not renew the gain code.

Incidentally, since an operation of the other constituent elements is almost the same as the case of the first embodiment, an explanation thereof will be omitted. However, as described above, the second embodiment is different from the first embodiment in that the code vector stored in the noise codebook is not renewed.

As explained above, according to the second embodiment, since the noise gain codebook renewal circuit 218 is used to occasionally renew or update the gain code stored in the noise gain codebook 215 of the coding device and the gain code stored in the noise gain codebook 230, the frequency characteristics at the time of voice can be improved in the unit of samples so that the noise sense is improved and the noise can be reduced.

Furthermore, since the renewal gain code s217 is sent to the decoding device from the coding device by using the surplus bit of the unvoice frame, the transmission channel can be effectively used and the transmission speed as a whole is not affected.

Third Embodiment

Next, a third embodiment of the present invention will be explained. The third embodiment is an example of renewing a pitch lag code (scalar amount) stored in the pitch lag codebook.

Figure 5:
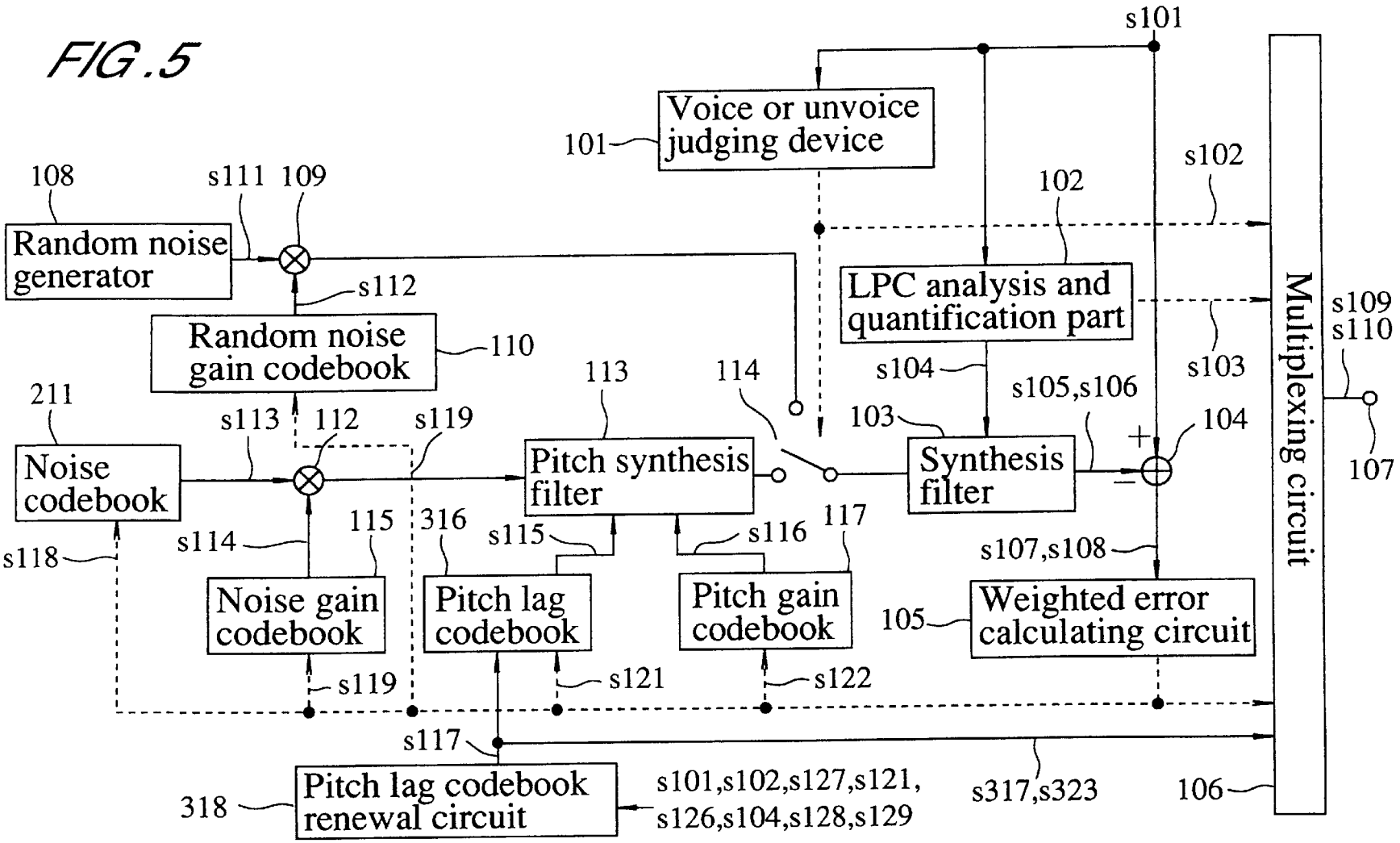
FIG. 5 is a block view of a coding device for coding speech signals according to a third embodiment of the invention.

FIG. 5 conceptually shows a structure of the coding device according to the third embodiment.

As shown in FIG. 5, this coding device comprises respective blocks of a voice or unvoice judging device 101, an LPC analysis and quantification part 102, a synthesis filter 103, an adding device 104, weighted error calculating circuit 105, a multiplexing circuit (multiplexer) 106, a sending terminal 107, a random noise generator 108, a multiplication device 109, a random noise gain codebook 110, a noise codebook 211, a multiplication device 112, a pitch synthesis filter 113, a switch 114, a noise gain codebook 115, a pitch lag codebook 316, a pitch gain codebook 117 and a pitch lag codebook renewal circuit 318.

In FIG. 5, the function of blocks having the same reference numerals as FIG. 1 is almost the same as the case of FIG. 1, so an explanation thereof will be omitted.

Furthermore, the noise codebook 211 stores only fixed code vectors and does not renew the code vector in the same manner as FIG. 3.

Figure 12:
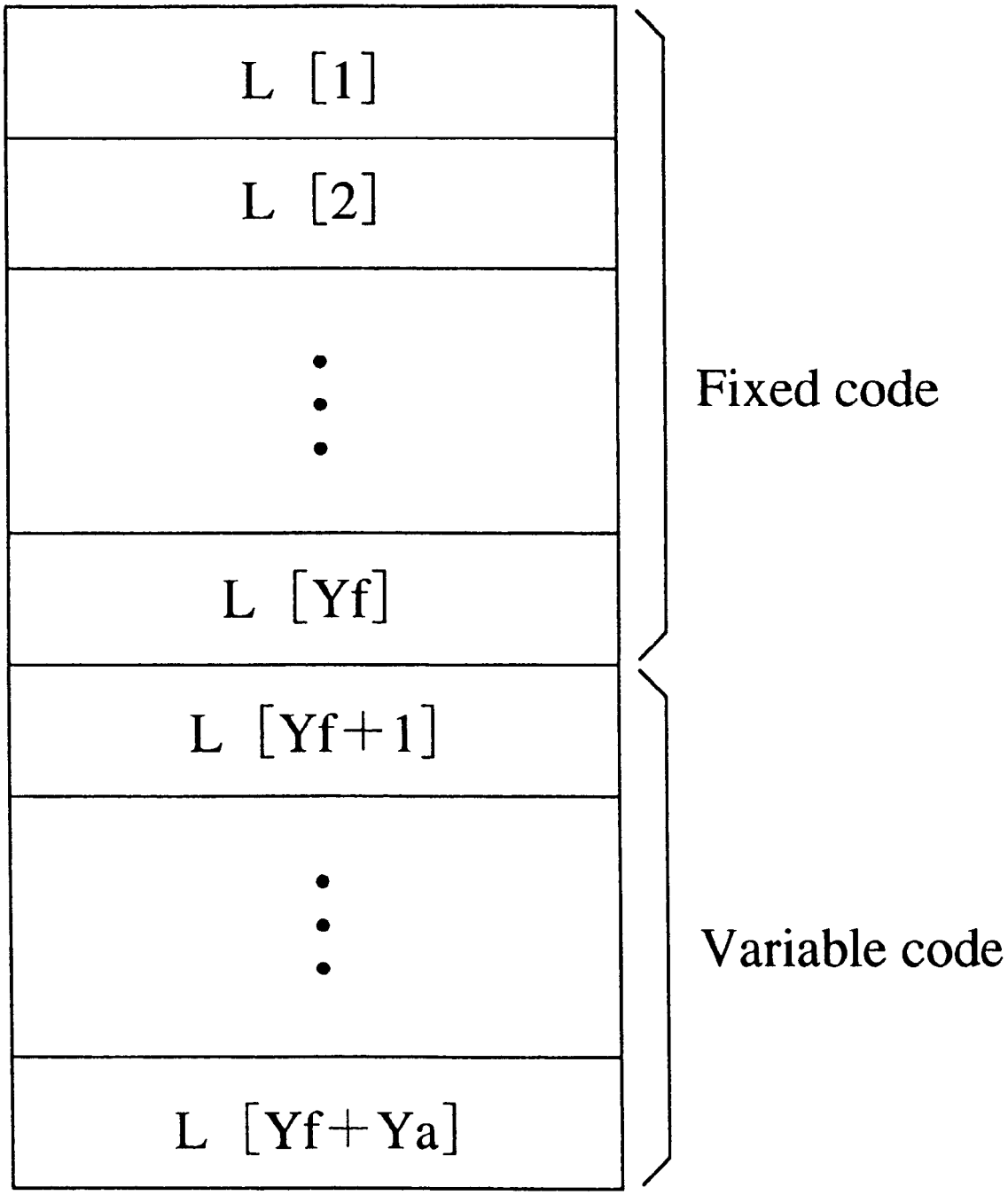
FIG. 12 is a concept view showing a structure of the quantification table for a pitch lag codebook according to the second aspect of the invention.

The pitch lag codebook 316 also stores $Y_a$ variable codes (these codes are both scalar amounts) in addition to $Y_f$ fixed codes unlike the case of the first and the second embodiments. FIG. 12 is a concept view showing the quantification table of this pitch lag codebook 316. As shown in FIG. 12, $Y_f$ code vectors L[1] through L[$Y_f$] out of Y (=$Y_f$+$Y_j$) code vectors are fixed vectors while $Y_a$ code vectors L[$Y_f$+1] through L[$Y_f$+$Y_a$] are variable code vectors. The variable code vectors L[$Y_f$+1] through L[$Y_f$+$Y_a$] have a certain initial value.

Furthermore, the coding device according to the third embodiment is provided with a pitch lag codebook renewal circuit 318. This pitch lag codebook renewal circuit 318 renews or updates the variable codes of the pitch lag codebook 316. A principle of generating the new pitch lag code s317 for renewal is the same as the case of the noise codebook renewal circuit shown in FIG. 1. In other words, a correlative value of the voice frame of the input speech vector s101 is subsequently calculated thereby making it possible to generate a new pitch lag code s317 by using the multiplication values of these correlative values.

A method for transmitting the renewal pitch lag code s317 to the decoding device is the same as the case of the aforementioned first embodiment. In other words, the surplus bit of (Ts−Tr) generated at the time of sending the unvoice frame as the total code s109 is used to transmit the renewal pitch lag code s317 and renewal flag value s223 to the decoding device.

Figure 23:
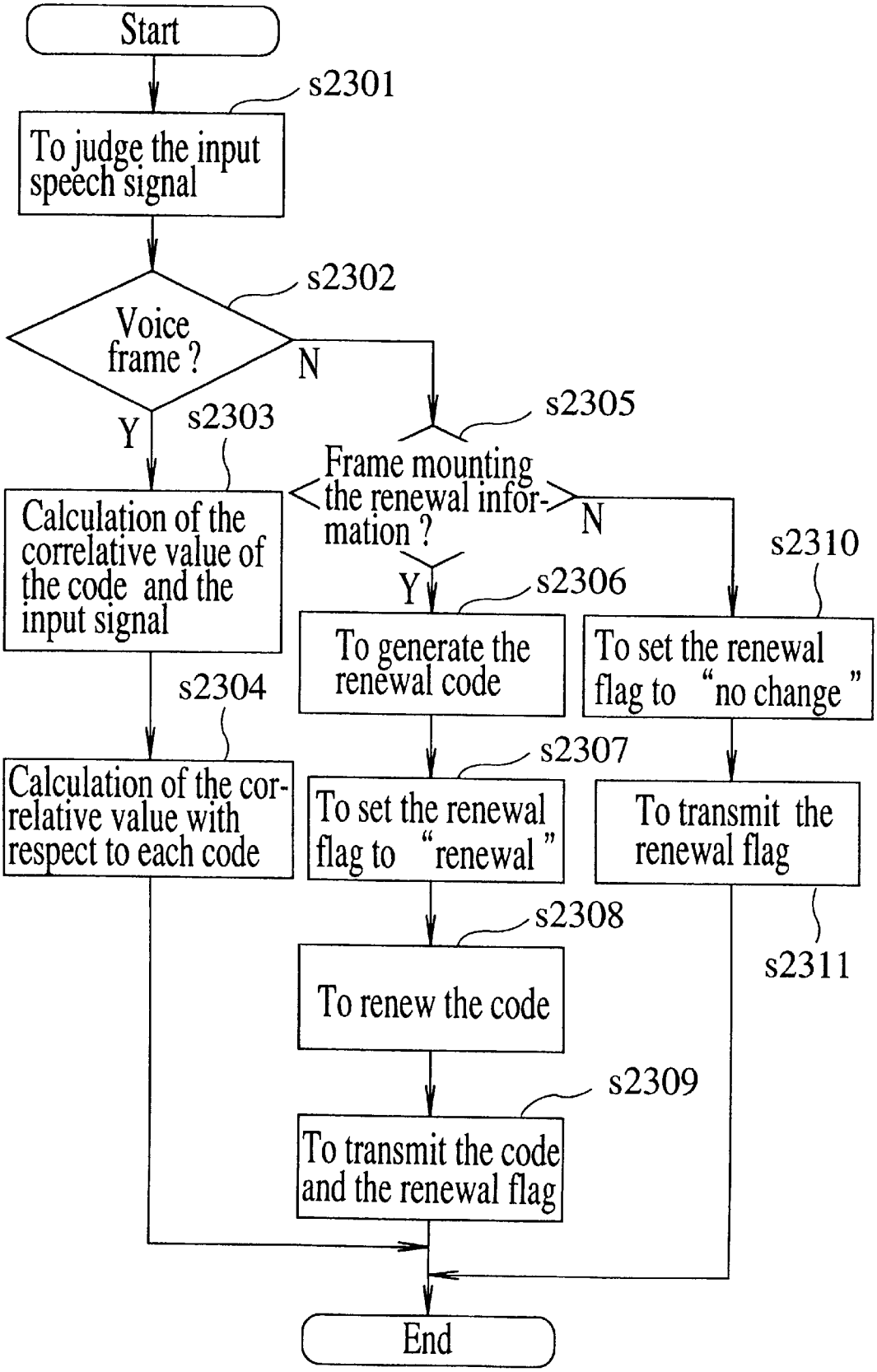
FIG. 23 is a flowchart showing the code renewal method according to the third embodiment of the invention.

An operation of renewing the pitch lag code of the pitch lag codebook 316 by using the pitch lag codebook renewal circuit 318 will be explained by using a flowchart of FIG. 23.

In the beginning, in the case where it is judged by the voice or unvoice judging device 101 that the frame of the input speech vector s101 is the voice frame (steps s2301, and s2302), the pitch lag codebook renewal circuit 318 calculates a long-term correlation with the selected pitch lag code and the input speech vector s101 (step s2303). Then, the calculation result further multiplied with the calculation result up to the previous process (step s2304). As a consequence, in the case where the voice frame continues as the frame of the input speech vector s101, the correlative value with respect to each of the pitch lag code is subsequently calculated.

On the other hand, in the case where it is judged that the input speech vector s101 is the unvoice frame, it is judged that the previous judgment result is the voice frame or the unvoice frame (in other words, the frame is the unvoice frame for mounting renewal pitch lag code or the frame for not mounting the code) (step s2305). Then, in the case where it is judged that the renewal pitch lag code s317 is the unvoice frame for mounting the renewal pitch lag code s317, the pitch lag code which is most frequently selected in each voice frame between the previous mounting of the renewal pitch lag code s317 to the current unvoice frame is judged, and, furthermore, the multiplication result obtained at the aforementioned step s2104 is used to calculate the renewal pitch lag code s317 (step s2306). Then, the renewal flag s333 is set to the "renewal" (step s2307). Subsequently, the renewal pitch lag code s317 is replaced with the oldest pitch lag code among the Ma variable codes so that the pitch lag code of the pitch lag codebook 316 is renewed (step s2308). Furthermore, at this time, the new pitch lag code s317 for renewal and the renewal flag s323 are sent to the multiplexing circuit 106. As described above, the multiplexing circuit 106 uses the surplus bit of the unvoice frame to transmit these data items s317 and s323 to the side of the decoding device (step s2309).

On the other hand, in the case where it is judged at the step s2305 that the renewal flag code s317 is the unvoice frame for not mounting the renewal pitch lag code s317, the renewal flag is set to "no change" (step s2310) followed by sending the renewal flag s323 to the multiplexing circuit 106 (step s2311).

Incidentally, an operation of these constituent elements is almost the same as the case of the first and the second embodiments, and an explanation thereof will be omitted. However, the code vector stored in the noise codebook 211 and the code stored in the noise gain codebook 115 are not renewed.

Figure 6:
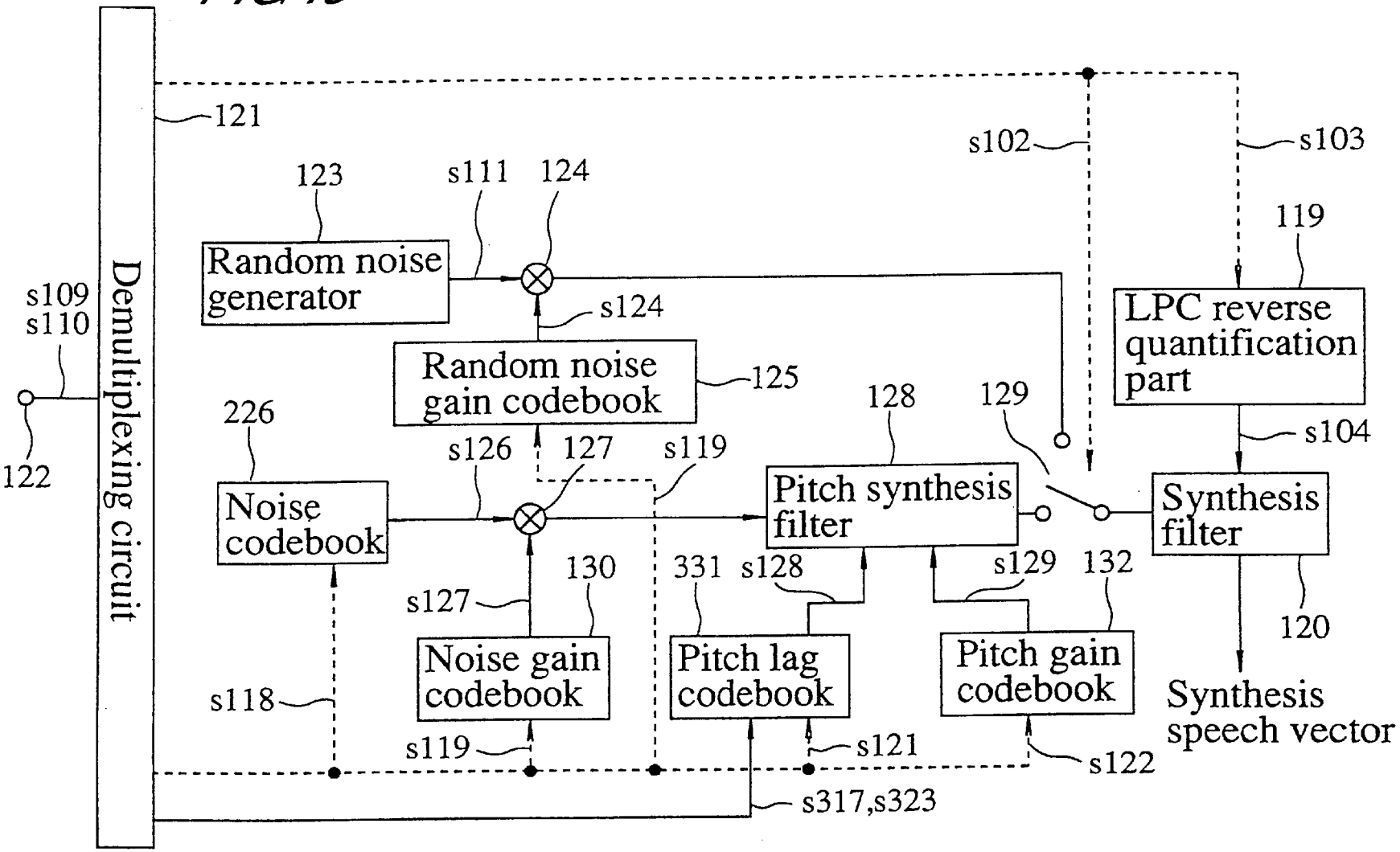
FIG. 6 is a block view of a decoding device for decoding speech signals according to the third aspect of the invention.

FIG. 6 conceptually shows a structure of the decoding device according to the third embodiment. As shown in FIG. 6, this decoding device comprises an input terminal 122, a demultiplexing circuit (demultiplexer) 121, a random noise generator 123, a random noise gain codebook 125, a multiplication device 124, a noise codebook 226, a noise gain codebook 130, a multiplication device 127, a pitch synthesis filter 128, a pitch lag codebook 331, a pitch gain codebook 132, a switch 129, an LPC reverse quantification part 119 and a synthesis filter 120.

In FIG. 6, the function of the blocks shown by the same reference numerals is almost the same as the case of FIG. 2, and an explanation thereof will be omitted.

The noise codebook 226 stores only the fixed vectors and is different from the noise codebook 126 of FIG. 2 in that the variable code vectors are not stored in the noise codebook 226. This is because the code vector stored in the noise codebook 226 is not renewed in the third embodiment.

The pitch lag codebook 331, unlike the case of the first embodiment, stores also $Y_a$ variable codes (these codes are both scalar amounts) in addition to $Y_f$ fixed codes.

An operation of the decoding device will be explained.

In the beginning, the demultiplexing circuit 121 receives from the input terminal 122 the total code s109 or s110, and demultiplexes or separates this total code s109 or s110.

Then, in the case where the voice or unvoice flag s102 is the unvoice, the pitch lag codebook 331 receives from the demultiplexing circuit 121 a renewed flag value s323. Then, in the case where this renewed flag value s323 shows "renewal", the pitch lag code s317 is subsequently input to the pitch lag codebook 331 and the pitch lag code of the pitch lag codebook 331 is renewed in the same manner as the coding device. On the other hand, in the case where the renewed flag value s323 shows "no change", the pitch lag codebook 331 does not renew (update) the pitch lag code.

Incidentally, an operation of the other constituent elements is almost the same as the case of the first embodiment, and an explanation thereof will be omitted. However, the code vector stored in the noise codebook 226 and the gain code stored in the noise gain codebook 130 are not renewed.

As explained above, according to the third embodiment, the pitch lag codebook renewal circuit 318 is used to occasionally renew the pitch lag code s317 stored in the pitch lag codebook 316 of the coding device and the pitch lag code s317 stored in the pitch lag codebook 331 of the decoding device so that the frequency characteristics at the time of voice can be improved by the sample unit and, therefore, the noise sense is improved to reduce the noise.

Furthermore, the pitch lag code s317 for the renewal is sent from the coding device to the decoding device by using the surplus bit of the unvoice frame so that the transmission channel can be effectively used and the transmission speed as a whole is not affected.

Fourth Embodiment

A fourth embodiment of the present invention will be explained. The fourth embodiment is an example of renewing the pitch gain code (scalar amount) stored in the pitch gain codebook.

Figure 7:
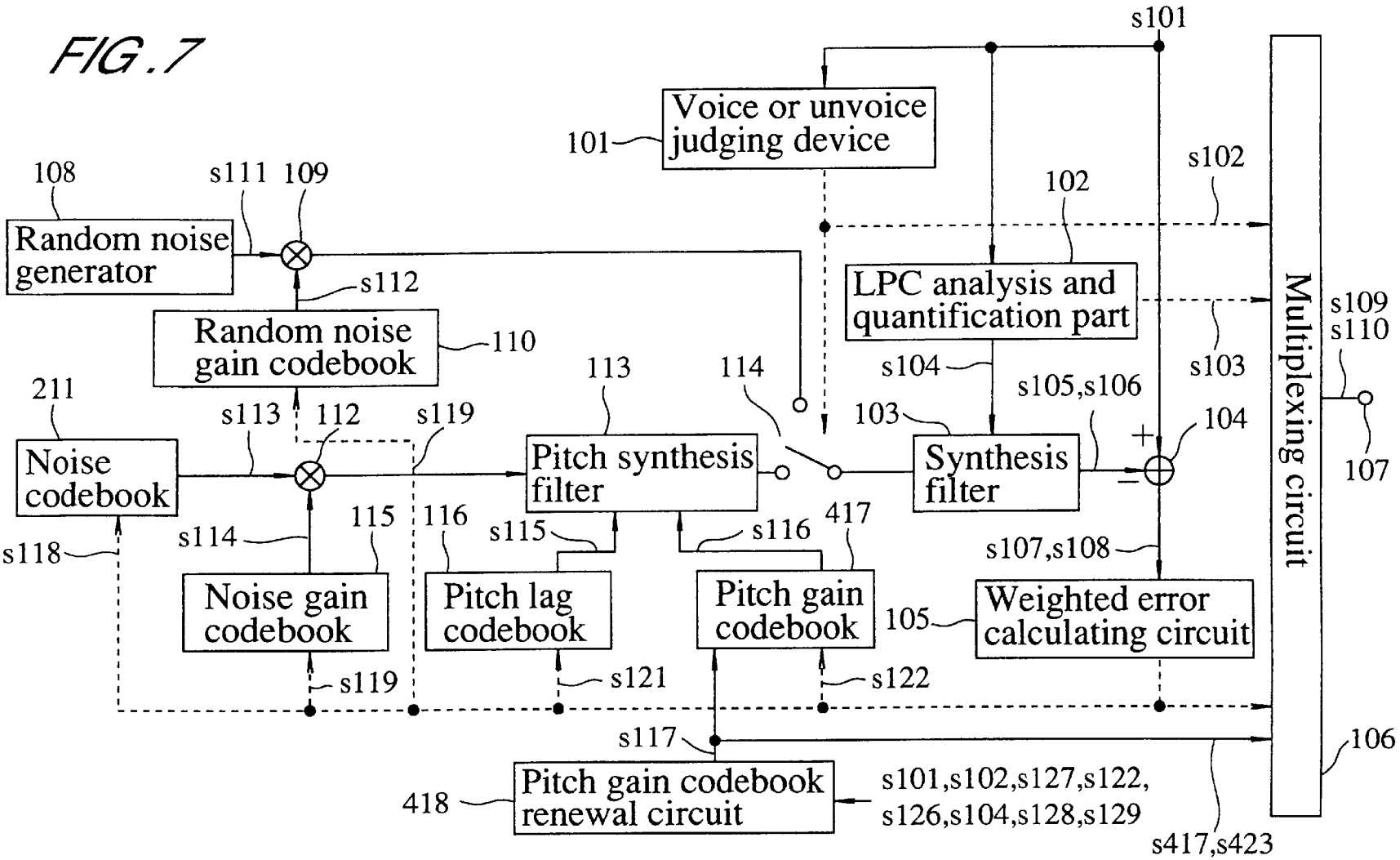
FIG. 7 is a block view of the coding device for coding speech signals according to a fourth embodiment of the invention.

FIG. 7 conceptually shows a structure of the coding device according to the fourth embodiment.

As shown in FIG. 7, this coding device comprises respective blocks of a voice or unvoice judging device 101, an LPC analysis and quantification part 102, a synthesis filter 103, an adding device 104, weighted error calculation circuit 105, a multiplexing circuit 106, a sending terminal 107, a random noise generator 108, a multiplication device 109, a random noise gain codebook 110, a noise codebook 211, a multiplication device 112, a pitch synthesis filter 113, a switch 114, a noise gain codebook 115, a pitch lag codebook 116, a pitch gain codebook 417, and a pitch gain codebook renewal (or update) circuit 418.

In FIG. 7, the function of blocks shown by the same reference numeral as FIG. 1 is almost the same as the case of FIG. 1, and an explanation thereof will be omitted.

Furthermore, the noise codebook 211 stores only the fixed code vectors and does not renew the code vectors.

Figure 13:
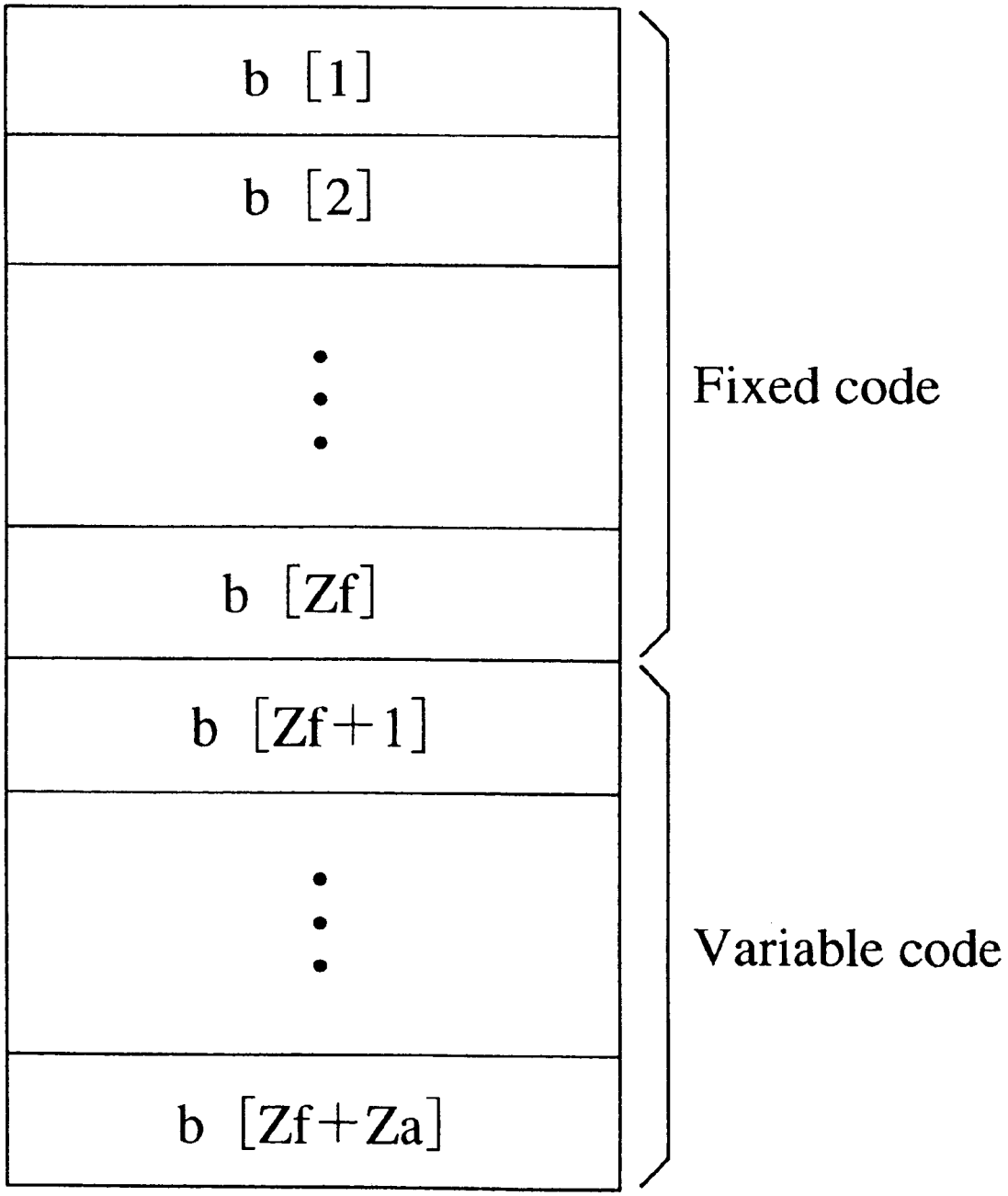
FIG. 13 is a concept view showing a structure of the quantification table for the pitch lag codebook according to the fourth embodiment of the invention.

The pitch gain codebook 417, unlike the case of the aforementioned each embodiment, also stores $Y_a$ variable code vectors, in addition to $Y_f$ fixed code vectors (these codes are both scalar amounts). FIG. 13 is a concept view showing a quantification table of this pitch gain codebook 417. As shown in FIG. 13, $Z_f$ code vectors b[1] through b[$Z_f$] out of Z(=$Y_f$+$Y_a$) code vectors b[1] through b[$Z_f$+$Z_a$] are fixed code vectors while $Z_a$ code vectors b[$Z_f$+1] through b[$Z_f$+$Z_a$] are variable code vectors. The variable code vectors b[$Z_f$+1] through b[$Z_f$+$Z_a$] have certain initial values.

Furthermore, the coding device according to this embodiment is provided with a pitch gain codebook renewal circuit 418. This pitch gain codebook renewal circuit 418 renews or updates the variable code of the pitch gain codebook 417. A principle of generating new pitch gain code s417 is the same as the case of the noise codebook renewal circuit 118 shown in FIG. 1. In other words, the correlative value of the voice frame of the input speech vector s101 is subsequently calculated, and a new pitch gain code s417 can be generated by using the multiplication value of these correlative values.

A method for transmitting the new pitch gain code for renewal s417 to the decoding device is the same as the case of the first embodiment. In other words, the surplus bits of (Ts−Tr) bit are used to transmit the pitch gain code s417 and the renewal flag value s423 to the decoding device.

Figure 24:
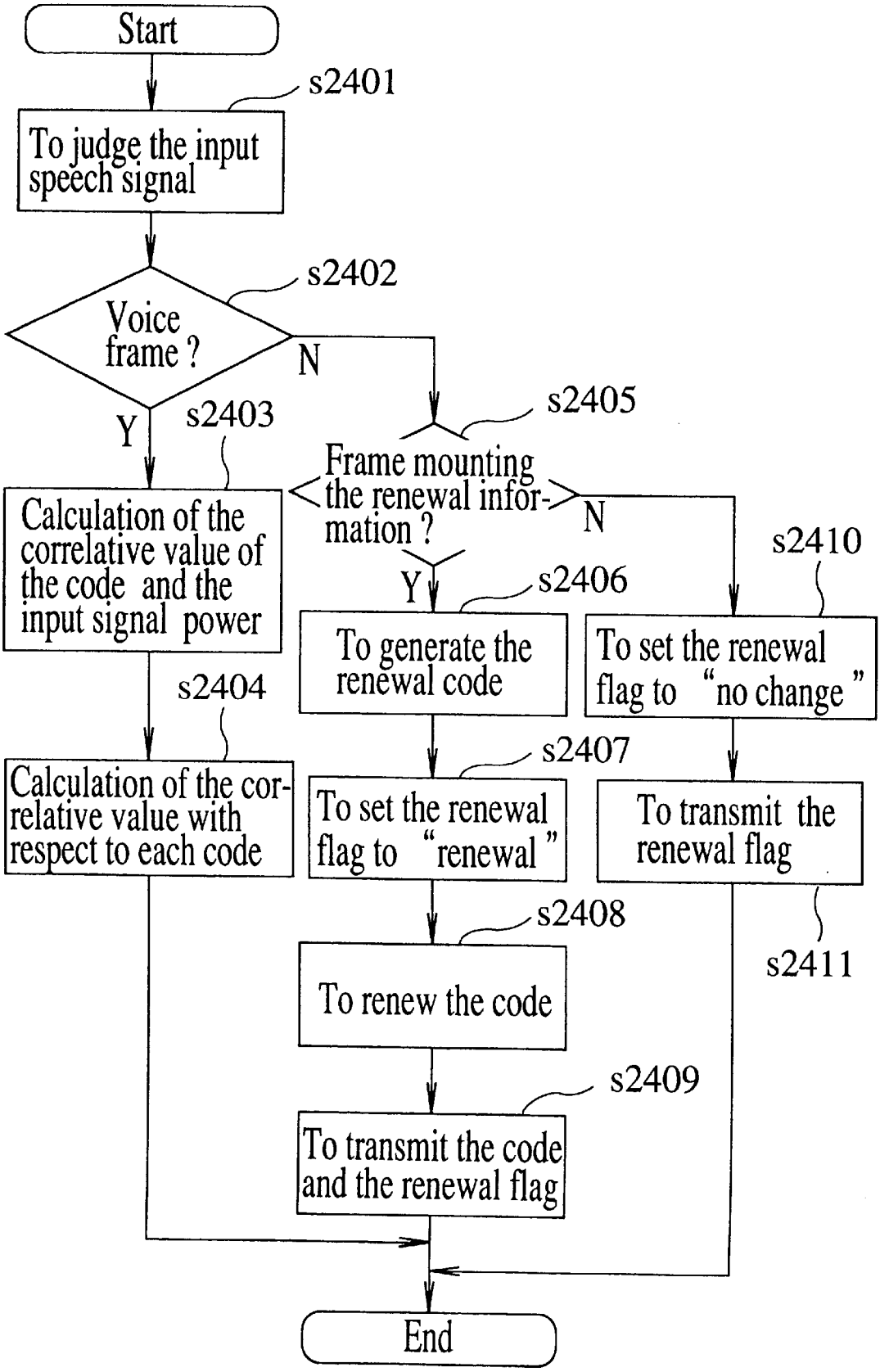
FIG. 24 is a flowchart showing the code renewal method according to the fourth embodiment of the invention.

Hereinafter, an operation of generating the pitch gain code of the pitch gain codebook 417 by using the pitch gain codebook renewal circuit 418 will be explained by using the flowchart of FIG. 24.

In the beginning, in the case where it is judged by the voice or unvoice judging device 101 that the frame of the input speech vector s101 is the voice frame (step s2401 and s2402), the pitch gain codebook renewal circuit 418 calculates a long-term correlation between the selected pitch gain code and the input speech vector s101 (step s2403). Then, the calculation result is further multiplied with the multiplication value of the calculation result in the previous process (step s2404). As a consequence, in the case where the voice frame continues as a frame of the input speech vector s101, the correlation value of each pitch gain code is subsequently calculated.

On the other hand, it is judged at steps s2401 and s2402 that the input speech vector s101 is the unvoice frame, it is judged whether the previous judgment result is the voice frame or the unvoice frame (in other words, whether the frame is the unvoice frame for mounting the renewal pitch gain code s417 or the frame for not mounting the renewal pitch gain code s417) (step s2405). Then, in the case where it is judged that the frame is the unvoice frame for mounting the renewal pitch gain code s417, the pitch gain code is judged which is most frequently selected in each voice frame between the mounting of the previous renewal pitch gain code s417 up to the unvoice frame in this process. Furthermore, the multiplication result obtained at the aforementioned step s2104 is used to calculate the new pitch gain code s417 for renewal (step s2406). Then, the renewal flag s433 is set to the "renewal" (step s2407). Subsequently, the pitch gain code of the noise gain codebook 115 is renewed or updated by replacing the renewal pitch gain code s417 with the oldest pitch gain code out of $M_a$ variable vectors (step s2408). Furthermore, at the same time, the renewal pitch gain code s417 and the renewal flag s423 are sent to the multiplexing circuit 106. As described above, the multiplexing circuit 106 uses the surplus bit to transmit these data items s417 and s423 to the side of the decoding device (step s2409).

On the other hand, in the case where it is judged at step s2405 that the frame is the unvoice frame for not mounting the renewal gain code s417, the renewal flag is set to the "no change" (step s2410) followed by sending this renewal flag value s423 to the multiplexing circuit 106. In this case, the surplus bit of the unvoice flag is used to send only this renewal flag value s423 (step s2411).

Incidentally, an operation of other constituent elements is almost the same as the case of the first and the second embodiments, and an explanation thereof will be omitted. However, the code vector stored in the noise codebook 211 and the code stored in the noise gain codebook 115 are not renewed.

Figure 8:
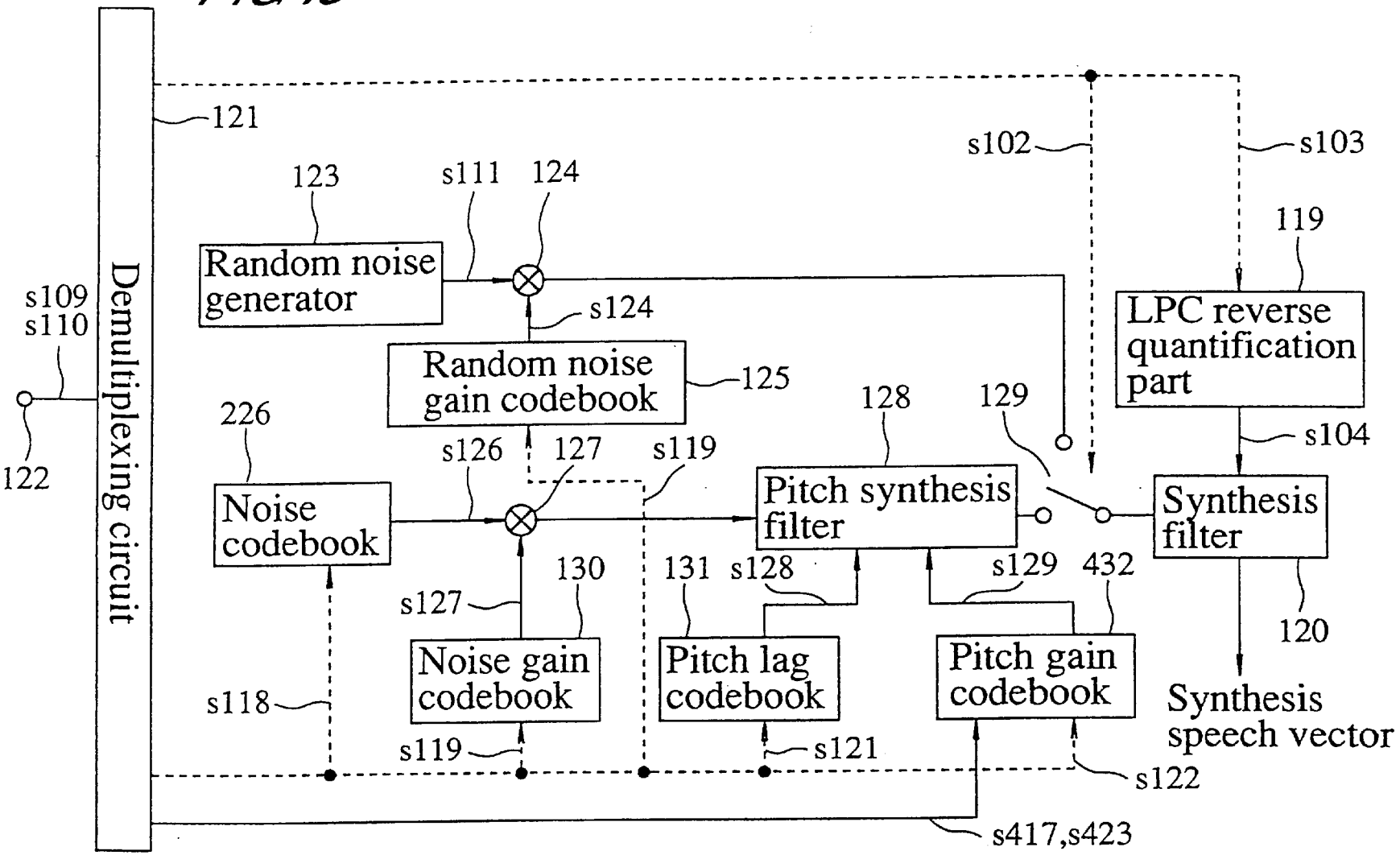
FIG. 8 is a block view of the decoding device for decoding speech signals according to the fourth embodiment of the invention.

FIG. 8 conceptually shows a structure of the decoding device according to the fourth embodiment. As shown in FIG. 8, this decoding device comprises an input terminal 122, a demultiplexing circuit (demultiplexer) 121, a random noise generator 123, a random noise gain codebook 125, a multiplication device 124, a noise codebook 226, a noise gain codebook 130, a multiplication device 127, a pitch synthesis filter 128, a pitch lag codebook 131, a pitch gain codebook 432, a switch 129, an LPC reverse quantification part 119 and a synthesis filter 120.

In FIG. 8, the function of blocks denoted by the same reference numeral as FIG. 2 is almost the same as the case of FIG. 2, and an explanation thereof will be omitted.

The noise codebook 226 stores only the fixed code vectors, and the noise codebook 226 is different from the noise codebook 126 of FIG. 2 in that the variable code vectors are not stored in the noise codebook 226. This is because in the fourth embodiment the code vector stored in the noise codebook 226 is not renewed.

The pitch gain codebook 432, unlike the case of the first embodiment, stores $Z_a$ variable codes (these codes are scalar amounts) in addition to $Z_f$ fixed codes.

An operation of the decoding device will be explained hereinbelow.

In the beginning, the demultiplexer 121 receives a total code s109 or s110 from the input terminal 122 and then demultiplexes or separates the total code s109 or s110.

Then, in the case where the voice or unvoice flag s102 is the unvoice, the pitch gain codebook 432 receives or inputs the renewal flag value s423 from the demultiplexing circuit 121. Then, in the case where the renewal flag value s423 is in a renewed state, the pitch gain codebook 432 receives the pitch gain code s417 to renew or update the previous pitch gain code. On the other hand, in the case where this renewal flag value s423 indicates "no change", the pitch gain codebook 432 does not renew the pitch gain code.

Incidentally, the operation of other constituent elements is almost the same as the case of the first embodiment, and an explanation thereof will be omitted. However, the code vector stored in the noise codebook 226, the gain code stored in the noise gain codebook 130, and the pitch lag stored in the pitch lag codebook 131 are not renewed.

As explained above, according to the fourth embodiment, the pitch gain codebook renewal circuit 418 is used to occasionally renew or update the pitch gain code stored in the pitch gain codebook of the coding device 417 and the pitch gain code stored in the pitch gain codebook 432 of the decoding device with the result that the frequency characteristics at the time of the voice can be improved in the unit of samples and so the noise sense can be improved to reduce the noise.

Furthermore, the pitch gain code s417 for renewal is sent from the coding device to the decoding device by using the surplus bit of the unvoice frame, the transmission channel can be effectively used and the transmission speed as a whole is not affected.

Incidentally, in each of the embodiments which have been explained so far, in the case where the information amount of the renewal code (noise code vector s117, the gain code s217, the pitch lag code s317, and the pitch gain code s417) is larger than the volume of the surplus bit of the unvoice frame, the information may be transmitted by dividing it into a plurality of frames. Otherwise, in the case where the renewal code is transmitted by dividing the code into a plurality of unvoice frames, the renewal code may be transmitted by dividing the code into two or more continuous unvoice frames, or may be transmitted by dividing the code into discontinuous unvoice frames. Furthermore, the unvoice frame used for the transmission of the renewal code may be selected depending on the characteristics of the transmission channel and the characteristics of the sent information.

FIG. 20 is a view showing an example of a method of transmitting such renewal code by dividing the code into two continuous unvoice frame in the case where the information amount of the renewal code is larger than the volume of the surplus bit of the unvoice frame. In FIG. 20, symbol ○ denotes a frame for mounting the renewal frame while symbol X denotes a frame for not mounting the renewal code. As shown in FIG. 20, in the case where the unvoice frame is not continuous, only the renewal code which can be transmitted by the unvoice frame is transmitted. Furthermore, in the case where two or more unvoice frames continue, the first two unvoice frames are used to transmit the renewal code. In the unvoice frame which is not used to transmit the renewal code, what is transmitted in the (Ts−Tr) area is only the renewal flags s123, s223, s323 and s423.

Furthermore, as shown in each of the aforementioned embodiment, the renewal code may be the vector amount, or may be the scalar amount.

In this invention, the kind of the transmission channel is not particularly limited to any kind. The transmission channel may be a radio transmission channel or may be a wired transmission channel.

In each of the aforementioned embodiments, the renewal code is transmitted by using the surplus bit of the unvoice frame, but the renewal code can be transmitted without using the surplus bit.

Furthermore, in each of the aforementioned embodiments, a CELP type is used as the LPC analysis and quantification part 102. However, another type, for example, an embodiment using a pulse driven type, a residual difference driven type and a quantification table can be used.

As explained in detail, according to the present invention, since the quantification table code used for the quantification of the voice information is occasionally used, the frequency characteristics at the time of the voice can be improved, and an attempt can be made to improve the noise sense thereby reducing the noise.

Furthermore, information for the renewal of the quantification table code is sent to the decoding device from the coding device by using the surplus bit of the unvoice frame with the result that the transmission channel can be effectively used and the transmission speed as a whole is not affected.

What is claimed is:

1. A coding device for coding an input speech vector including voice frames and unvoice frames, said coding device comprising:

a codebook, including a quantification table stored in said codebook, operable for coding the speech vector, during the voice frames of the speech vector, by selecting a code, from said quantification table, most suitable to a characteristic of the speech vector;

a codebook renewal circuit operable to determine a correlative value between the speech vector and the code selected by said codebook, determine a most-frequently-selected code as a code of the quantification table which is selected most frequently, generate a renewal code based on the correlative value, and replace the most-frequently-selected code with the renewal code in said quantification table of said codebook;

wherein said coding device is operable to transmit the renewal code in a surplus bit portion of an unvoice frame of information sent from said coding device.

2. A coding device as claimed in claim 1, wherein said codebook renewal circuit is operable to calculate the correlative value over a period of a plurality of frames of the input speech vector.

3. A coding device as claimed in claim wherein said codebook renewal circuit is operable to determine the most-frequently-selected code as a code of the quantification table which has been selected most frequently since a previous renewal of a code by said codebook renewal circuit.

4. A coding device as claimed in claim 1, wherein said codebook renewal circuit is operable to generate a renewal code every time the input speech vector changes from a voice frame to an unvoice frame.

5. A coding device as claimed in claim 4, wherein said quantification table of said codebook is a table for storing a noise code vector which is a vector amount indicative of a noise.

6. A coding device as claimed in claim 1, wherein said codebook renewal circuit is operable to set a value of a renewal flag when generating the renewal code.

7. A coding device as claimed in claim 6, wherein said quantification table of said codebook is a table for storing a noise code vector which is a vector amount indicative of a noise.

8. A coding device as claimed in claim 7, further comprising a sending circuit operable to send the renewal code and the value of the renewal flag in the surplus bit portion of the unvoice frame of the information sent from said coding device.

9. A coding device as claimed in claim 8, wherein said quantification table of said codebook is a table for storing a noise code vector which is a vector amount indicative of a noise.

10. A coding device as claimed in claim 8, wherein said sending circuit is a multiplexing circuit.

11. A coding device as claimed in claim 10, wherein said quantification table of said codebook is a table for storing a noise code vector which is a vector amount indicative of a noise.

12. A coding device as claimed in claim 1, wherein said quantification table of said codebook is a table for storing a fixed code which cannot be renewed by said codebook renewal circuit and a variable code which can be renewed by said codebook renewal circuit.

13. A coding device as claimed in claim 12, wherein said quantification table of said codebook is a table for storing a noise code vector which is a vector amount indicative of a noise.

14. A coding device as claimed in claim 1, wherein said quantification table of said codebook is a table for storing a noise code vector which is a vector amount indicative of a noise.

15. A coding device as claimed in claim 1, wherein said quantification table of said codebook is a table for storing a noise gain code which is a scalar amount indicative of a gain of noise.

16. A coding device as claimed in claim 1, wherein said quantification table of said codebook is a table for storing a pitch lag code which is a scalar amount indicative of a pitch cycle of speech.

17. A coding device as claimed in claim 1, wherein said quantification table of said codebook is a table for storing a pitch gain code which is a scalar amount indicative of a degree of a pitch cycle.

18. A coding device for coding an input speech vector including voice frames and unvoice frames, said coding device comprising:

a codebook, including a quantification table stored in said codebook, operable for coding the speech vector, during the voice frames of the input speech vector, by selecting a code, from said quantification table, most suitable to a characteristic of the speech vector;

a codebook renewal circuit operable to determine a correlative value between the speech vector and the code selected by said codebook, determine an oldest code as a renewable code of said quantification table having a longest passage of time since being renewed, generate a renewal code based on the correlative value, and replace the oldest code with the renewal code in said quantification table of said codebook;

wherein said coding device is operable to transmit the renewal code in a surplus bit portion of an unvoice frame of information sent from said coding device.

19. A coding device as claimed in claim 18, wherein said codebook renewal circuit is operable to calculate the correlative value over a period of a plurality of frames of the input speech vector.

20. A coding device as claimed in claim 18, wherein said codebook renewal circuit is operable to generate a renewal code every time the input speech vector changes from a voice frame to an unvoice frame.

21. A coding device as claimed in claim 20, wherein said quantification table of said codebook is a table for storing a noise code vector which is a vector amount indicative of a noise.

22. A coding device as claimed in claim 18, wherein said codebook renewal circuit is operable to set a value of a renewal flag when generating the renewal code.

23. A coding device as claimed in claim 22, wherein said quantification table of said codebook is a table for storing a noise code vector which is a vector amount indicative of a noise.

24. A coding device as claimed in claim 22, further comprising a sending circuit operable to send the renewal code and the value of the renewal flag in the surplus bit portion of the unvoice frame of the information sent from said coding device.

25. A coding device as claimed in claim 24, wherein said quantification table of said codebook is a table for storing a noise code vector which is a vector amount indicative of a noise.

26. A coding device as claimed in claim 24, wherein said sending circuit is a multiplexing circuit.

27. A coding device as claimed in claim 26, wherein said quantification table of said codebook is a table for storing a noise code vector which is a vector amount indicative of a noise.

28. A coding device as claimed in claim 18, wherein said quantification table of said codebook is a table for storing a fixed code which cannot be renewed by said codebook renewal circuit and a variable code which can be renewed by said codebook renewal circuit.

29. A coding device as claimed in claim 28, wherein said quantification table of said codebook is a table for storing a noise code vector which is a vector amount indicative of a noise.

30. A coding device as claimed in claim 18, wherein said quantification table of said codebook is a table for storing a noise code vector which is a vector amount indicative of a noise.

31. A coding device as claimed in claim 18, wherein said quantification table of said codebook is a table for storing a noise gain code which is a scalar amount indicative of a gain of noise.

32. A coding device as claimed in claim 18, wherein said quantification table of said codebook is a table for storing a pitch lag code which is a scalar amount indicative of a pitch cycle of speech.

33. A coding device as claimed in claim 18, wherein said quantification table of said codebook is a table for storing a pitch gain code which is a scalar amount indicative of a degree of a pitch cycle.

34. A decoding device for decoding a received speech vector including voice frames and unvoice frames, said decoding device comprising:

a receiving circuit operable to pick up most-appropriate-code information from the voice frames of the received speech vector and a renewal code from a surplus bit portion of an unvoice frame of the received speech vector;

a codebook, including a quantification table stored in said codebook, operable to perform a decoding procedure in order to decode the received speech vector during the voice frames of the received speech vector by selecting a code corresponding to the most-appropriate-code information from the quantification table, and operable to perform a renewal procedure by replacing the code selected by said codebook with the renewal code received by said receiving circuit.

35. A decoding device as claimed in claim 34, wherein said codebook is operable to perform the renewal procedure every time the received speech vector changes from a voice frame to an unvoice frame.

36. A decoding device as claimed in claim 34, wherein said codebook is operable to replace an oldest replaceable code in said quantification table with the renewal code.

37. A decoding device as claimed in claim 34, wherein said decoding device is operable to receive a renewal flag together with the renewal code, and to perform the renewal procedure at a time when the renewal flag indicates a presence of the renewal code.

38. A decoding device as claimed in claim 37, wherein said receiving circuit is operable to pick up the renewal code and the renewal flag from the surplus bit portion of the unvoice frame of the received speech vector.

39. A decoding device as claimed in claim 34, wherein said receiving circuit is a demultiplexing circuit.

40. A decoding device as claimed in claim 34, wherein said quantification table of said codebook is a table for storing a fixed code which cannot be renewed by the renewal procedure and a variable code which can be renewed by the renewal procedure.

41. A decoding device as claimed in claim 34, wherein said quantification table of said codebook is a table for storing a noise code vector which is a vector amount representing a noise.

42. A decoding device as claimed in claim 34, wherein said quantification table of said codebook is a table for storing a noise gain code which is a scalar amount representing a gain of noise.

43. A decoding device as claimed in claim 34, wherein said quantification table of said codebook is a table for storing a pitch lag code which is a scalar amount representing a pitch cycle of speech.

44. A decoding device as claimed in claim 34, wherein said quantification table of said codebook is a table for storing a pitch gain code which is a scalar amount representing a degree of a pitch cycle.

45. A coding method for coding an input speech vector including voice frames and unvoice frames, said method comprising:

coding the input speech vector during the voice frames by selecting a code most appropriate to a characteristic of the input speech vector from a quantification table;

determining a correlative value between the speech vector and the selected code;

determining a most-frequently-selected code as a code of the quantification table which is selected most frequently;

generating a renewal code based on the correlative value;

replacing the most-frequently-selected code with the renewal code in the quantification table; and transmitting the renewal code in a surplus bit portion of an unvoice frame of sent information.

46. A coding method as claimed in claim 45, wherein said determining of the correlative value includes determining the correlative value over a period of a plurality of frames of the input speech vector.

47. A coding method as claimed in claim 45, wherein said determining of the most-frequently-selected code includes determining the most-frequently-selected code as a code of the quantification table which has been selected most frequently since a previous renewal of a code.

48. A coding method as claimed in claim 45, wherein said generating of a renewal code is performed every time the input speech vector changes from a voice frame to an unvoice frame.

49. A coding method as claimed in claim 45, further comprising setting a value of a renewal flag when generating the renewal code.

50. A coding method as claimed in claim 49, wherein said transmitting includes sending the renewal code and the value of the renewal flag in the surplus bit portion of the unvoice frame of the sent information.

51. A coding method as claimed in claim 50, wherein said transmitting includes performing multiplexing transmission.

52. A coding method as claimed in claim 45, wherein the quantification table is a table for storing a fixed code which cannot be renewed by said replacing and a variable code which can be renewed by said replacing.

53. A coding device as claimed in claim 45, wherein the quantification table is a table for storing a noise code vector which is a vector amount indicative of a noise.

54. A coding device as claimed in claim 45, wherein the quantification table is a table for storing a noise gain code which is a scalar amount indicative of a gain of noise.

55. A coding device as claimed in claim 45, wherein the quantification table is a table for storing a pitch lag code which is a scalar amount indicative of a pitch cycle of speech.

56. A coding device as claimed in claim 45, wherein the quantification table is a table for storing a pitch gain code which is a scalar amount indicative of a degree of a pitch cycle.

57. A coding method for coding an input speech vector including voice frames and unvoice frames, said method comprising:

coding the input speech vector during the voice frames by selecting a code most appropriate to a characteristic of the input speech vector from a quantification table;

determining a correlative value between the speech vector and the selected code;

determining an oldest code as a renewable code of the quantification table having a longest passage of time since being renewed;

generating a renewal code based on the correlative value;

replacing the oldest code with the renewal code in the quantification table; and transmitting the renewal code in a surplus bit portion of an unvoice frame of sent information.

58. A coding method as claimed in claim 57, wherein said determining of the correlative value includes determining the correlative value over a period of a plurality of frames of the input speech vector.

59. A coding method as claimed in claim 57, wherein said generating of a renewal code is performed every time the input speech vector changes from a voice frame to an unvoice frame.

60. A coding method as claimed in claim 57, further comprising setting a value of a renewal flag when generating the renewal code.

61. A coding method as claimed in claim 60, wherein said transmitting includes sending the renewal code and the value of the renewal flag in the surplus bit portion of the unvoice frame of the sent information.

62. A coding method as claimed in claim 61, wherein said transmitting includes performing multiplexing transmission.

63. A coding method as claimed in claim 57, wherein the quantification table is a table for storing a fixed code which cannot be renewed by said replacing and a variable code which can be renewed by said replacing.

64. A coding device as claimed in claim 57, wherein the quantification table is a table for storing a noise code vector which is a vector amount indicative of a noise.

65. A coding device as claimed in claim 57, wherein the quantification table is a table for storing a noise gain code which is a scalar amount indicative of a gain of noise.

66. A coding device as claimed in claim 57, wherein the quantification table is a table for storing a pitch lag code which is a scalar amount indicative of a pitch cycle of speech.

67. A coding device as claimed in claim 57, wherein the quantification table is a table for storing a pitch gain code which is a scalar amount indicative of a degree of a pitch cycle.

68. A decoding method for decoding a received speech vector including voice frames and unvoice frames, for use with a quantification table, said decoding method comprising:

receiving most-appropriate-code information from the voice frames of the received speech vector and a renewal code from a surplus bit portion of an unvoice frame of the received speech vector;

decoding the received speech vector during the voice frames of the received speech vector by selecting a code corresponding to the most-appropriate-code information from the quantification table;

replacing a specified code of a voice characteristic in the quantification table with the renewal code.

69. A decoding method as claimed in claim 68, wherein said replacing is performed every time the received speech vector changes from a voice frame to an unvoice frame.

70. A decoding method as claimed in claim 68, wherein said replacing includes replacing a renewable code of the quantification table having a longest passage of time since being renewed with the renewal code.

71. A decoding method as claimed in claim 68, further comprising picking up a value of a renewal flag together with the renewal code, wherein said replacing is performed when the value of the renewal flag indicates a presence of the renewal code.

72. A decoding method as claimed in claim 71, wherein said receiving includes receiving the renewal code and the renewal flag from the surplus bit portion of the unvoice frame of the received speech vector.

73. A decoding method as claimed in claim 68, wherein said receiving includes demultiplexing the received speech vector.

74. A decoding method as claimed in claim 68, wherein the quantification table is a table for storing a fixed code which cannot be renewed by said replacing and a variable code which can be renewed by said replacing.

75. A decoding method as claimed in claim 68, wherein the quantification table is a table for storing a noise code vector which is a vector amount indicative of a noise.

76. A decoding method as claimed in claim 68, wherein the quantification table is a table for storing a noise gain code which is a scalar amount indicative of a gain of noise.

77. A decoding method as claimed in claim 68, wherein the quantification table is a table for storing a pitch lag code which is a scalar amount indicative of a pitch cycle of speech.

78. A decoding method as claimed in claim 68, wherein the quantification table is a table for storing a pitch gain code which is a scalar amount indicative of a degree of a pitch cycle.

79. A machine-readable data signal embodied in a transmission signal on a transmission channel for use with a decoding device including a quantification table containing codes for speech characteristics, said machine-readable data signal comprising:

a voice frame including characteristics of transmitted speech; and an unvoice frame including a surplus bit portion containing a renewal code for replacing a code of a voice characteristic in the quantification table of the decoding device.

80. A machine-readable data signal as claimed in claim 79, wherein said unvoice frame further includes a value of a renewal flag indicative of a presence of the renewal code in said unvoice frame.

81. A machine-readable data signal as claimed in claim 80, further comprising a further unvoice frame including a value of a renewal flag indicative of a lack of presence of the renewal code in said further unvoice frame.

* * * * *